US008783856B2

(12) United States Patent
Matsunaga

(10) Patent No.: US 8,783,856 B2
(45) Date of Patent: Jul. 22, 2014

(54) PRINTING APPARATUS AND PRINTING METHOD

(75) Inventor: Hirotaka Matsunaga, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 120 days.

(21) Appl. No.: 13/356,777

(22) Filed: Jan. 24, 2012

(65) Prior Publication Data

US 2012/0188322 A1 Jul. 26, 2012

(30) Foreign Application Priority Data

Jan. 24, 2011 (JP) ..... 2011-012089

(51) Int. Cl.
*B41J 2/01* (2006.01)
*B41J 2/21* (2006.01)

(52) U.S. Cl.
USPC ..... 347/104; 347/43

(58) Field of Classification Search
None
See application file for complete search history.

(56) References Cited

U.S. PATENT DOCUMENTS 7,407,277 B2 8/2008 Yoneyama
8,506,048 B2 * 8/2013 Sano ..... 347/43
2003/0142168 A1 * 7/2003 Suzuki et al. ..... 347/43
2005/0068399 A1 * 3/2005 Suzuki et al. ..... 347/104
2009/0322814 A1 * 12/2009 Sano ..... 347/12
2010/0253724 A1 * 10/2010 Matsuzawa et al. ..... 347/12

FOREIGN PATENT DOCUMENTS

JP 2003-285427 A 10/2003
JP 2005-007671 A 1/2005
JP 2009-113284 A 11/2007
JP 2008-200850 A 9/2008
JP 2008-200853 A 9/2008

* cited by examiner

*Primary Examiner* — Matthew Luu
*Assistant Examiner* — Tracey McMillion
(74) *Attorney, Agent, or Firm* — Nutter McClennen & Fish LLP; John J. Penny, Jr.; Rory P. Pheiffer

(57) ABSTRACT

A printer includes: a transport unit that transports a roll of transparent medium; a first nozzles ejecting ink to form a color image; and a second nozzles ejecting ink to form a background image. When a plurality of printed images to be formed by overlapping the color image and the background image continue to be printed on the medium and when the background image of the printed image is located on the outside of the color image in a case where the medium is wound in the roll shape, a confirmation image formed by overlapping the color image and the background image is printed on an end portion of the medium to be wound in the roll shape so that at least a part of the color image is located on the outside of the background image.

6 Claims, 20 Drawing Sheets

IMAGE SUBJECTED TO FRONT PRINTING

IMAGE SUBJECTED TO REAR PRINTING

FIRST EMBODIMENT
(WHEN PRINTED IMAGES ARE LOCATED OUTSIDE AFTER WINDING)

SECOND EMBODIMENT
(WHEN PRINTED IMAGES ARE LOCATED INSIDE AFTER WINDING)

THIRD EMBODIMENT

THIRD EMBODIMENT
(WHEN PRINTED IMAGES ARE LOCATED OUTSIDE AFTER WINDING)

PRINTING METHOD IN S202 OF THIRD EMBODIMENT

MODIFICATION

| PASS 1 | PASS 2 | PASS 3 | PASS 4 | PASS 5 | PASS 6 | PASS 7 | PASS 8 |
|---|---|---|---|---|---|---|---|
| FORWARD | BACKWARD | FORWARD | BACKWARD | BACKWARD | FORWARD | BACKWARD | FORWARD |
| ODD NUMBER | ODD NUMBER | ODD NUMBER | ODD NUMBER | EVEN NUMBER | EVEN NUMBER | EVEN NUMBER | EVEN NUMBER |

PRINTING APPARATUS AND PRINTING METHOD

Priority is claimed under 35 U.S.C. §119 to Japanese Application No. 2011-012089 filed on Jan. 24, 2011 which are hereby incorporated by reference in its entirety.

BACKGROUND

1. Technical Field

The present invention relates to a printing apparatus and a printing method.

2. Related Art

There is a technique for printing a background image of a background color such as white and a color image on a transparent medium (see JP-A-2003-285427). When the color image is viewed from the printed surface of the medium, the background image is first printed on the medium and the color image is then printed on the background image. This printing method is referred to as "front printing." On the contrary, when the color image is viewed from the rear surface of the transparent medium, the color image is first printed on the medium and the background image is then printed on the color image. This printing method is referred to as "rear printing."

An example of the related art is JP-A-2009-113284.

When the color image is viewed from the front surface of the medium in the front printing, it is easy to view the color image due to the fact that the color image is printed on the background image. However, when the color image is viewed from the rear surface of the medium, it is difficult to view the color image due to the fact that the color image is hidden behind the background image.

On the other hand, when the color image is viewed from the rear surface of the medium in the rear printing, it is easy to view the color image due to the fact that the color image is printed on the background image. However, when the color image is viewed from the front surface of the medium, it is difficult to view the color image due to the fact that the color image is hidden behind the background image.

When the medium on which the color image and the background image overlap each other is wound in a roll shape, it is sometimes difficult to confirm the color image from the outside of the medium. In this case, since the medium wound in the roll shape has to be unrolled, confirming the printed image is inconvenient.

SUMMARY

An advantage of some aspects of the invention is that it provides a technique for facilitating confirmation of an image printed on a medium wound in a roll shape.

According to an aspect of the invention, there is provided a printing apparatus which includes: a transport unit that transports a transparent medium and winds the medium subjected to printing in a roll shape; a first nozzle line in which a plurality of nozzles ejecting ink to form a color image are arranged; and a second nozzle line in which a plurality of nozzles ejecting ink to form a background image are arranged. When a plurality of printed images to be formed by overlapping the color image and the background image continue to be printed on the medium and when the background image of the printed image is located on the outside of the color image in a case where the medium is wound in the roll shape, a confirmation image formed by overlapping the color image and the background image is printed on an end portion of the medium to be wound in the roll shape so that at least a part of the color image is located on the outside of the background image.

The other features of the invention are apparent from the description of the specification and the accompanying drawings.

BRIEF DESCRIPTION OF THE DRAWINGS

The invention will be described with reference to the accompanying drawings, wherein like numbers reference like elements.

FIG. 5A is the diagram illustrating the positions of a head and the forms of dots at pass 1 to pass 4, and FIG. 5B is the diagram illustrating the positions of the head and the forms of dots at pass 1 to pass 8.

DESCRIPTION OF EXEMPLARY EMBODIMENTS

Figure 1:
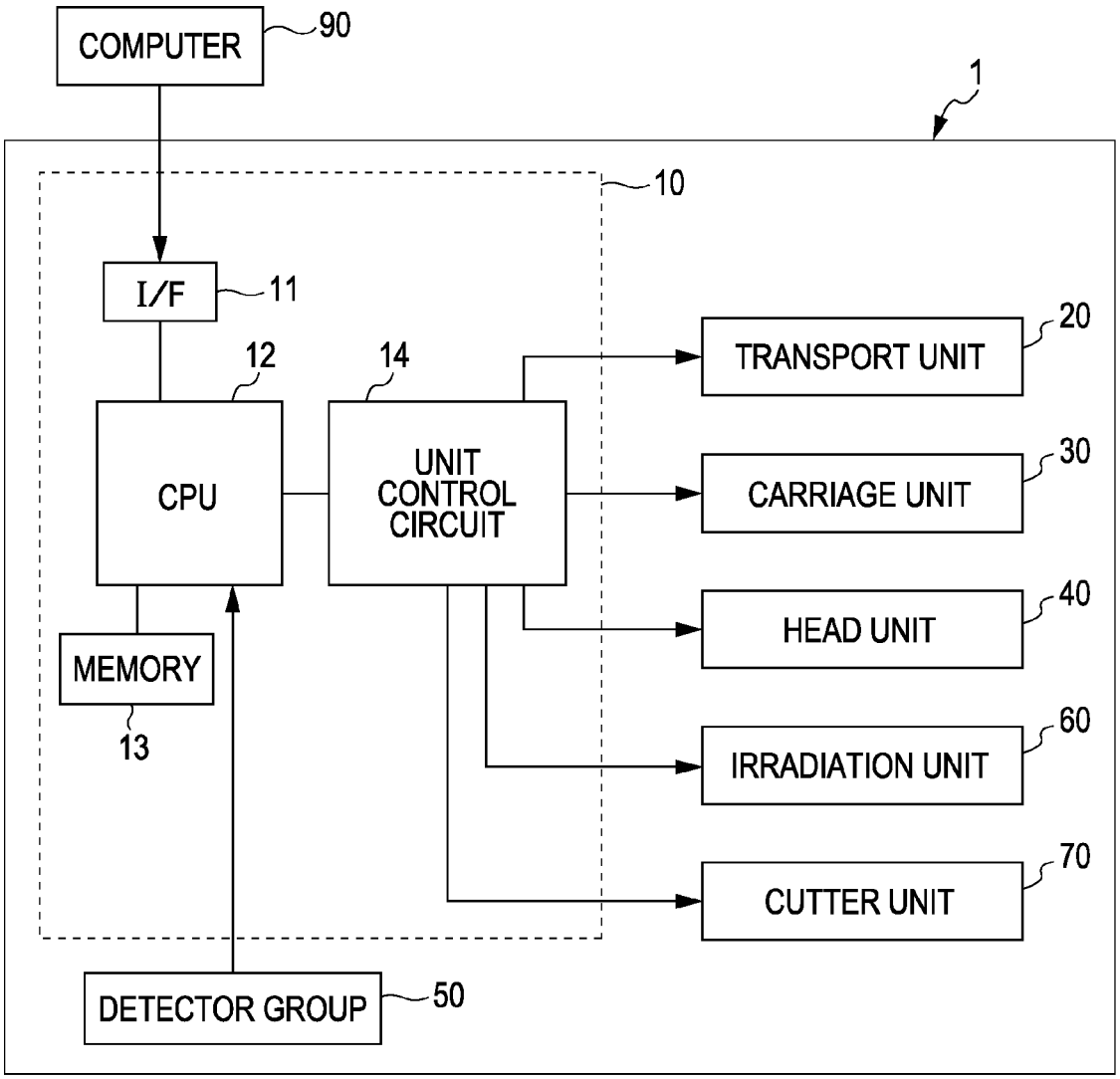
FIG. 1 is a block diagram illustrating the overall configuration of a printer.

At least, the following aspects are apparent from the description of the specification and the accompanying drawings.

According to an aspect of the invention, there is provided a printing apparatus which includes: a transport unit that transports a transparent medium and winds the medium subjected to printing in a roll shape; a first nozzle line in which a plurality of nozzles ejecting ink to form a color image are arranged; and a second nozzle line in which a plurality of nozzles ejecting ink to form a background image are arranged. When a plurality of printed images to be formed by overlapping the color image and the background image continue to be printed on the medium and when the background image of the printed image is located on the outside of the color image in a case where the medium is wound in the roll shape, a confirmation image formed by overlapping the color image and the background image is printed on an end portion of the medium to be wound in the roll shape so that at least a part of the color image is located on the outside of the background image.

In the printing apparatus, it is easy to confirm the printed image printed on the medium wound in the roll shape.

The transport unit may wind the medium subjected to the printing in the roll shape so that a printed surface of the medium faces the outside. When the plurality of printed images to be formed by overlapping the background image on the color image continue to be printed on the medium, the confirmation image formed by overlapping the color image on the background image may be printed on the end portion of the medium to be wound in the roll shape. Accordingly, it is easy to confirm the printed image printed on the medium wound in the roll shape.

The transport unit may wind the medium subjected to the printing in the roll shape so that a printed surface of the medium faces the inside. When the plurality of printed images to be formed by overlapping the color image on the background image continue to be printed on the medium, the confirmation image formed by overlapping the background image on the color image may be printed on the end portion of the medium to be wound in the roll shape. Accordingly, it is easy to confirm the printed image printed on the medium wound in the roll shape.

The confirmation image may be printed by allowing pixels in which background dots of the background image are formed on color dots of the color image and pixels in which the color dots are formed on the background dots to coexist. Accordingly, it is possible to confirm the confirmation image from both sides.

The color image and the background image may be formed on the medium by repeating a dot forming operation of forming the color dots and the background dots on the medium by ejecting the ink from the first and second nozzle lines while moving the first and second nozzle lines in a movement direction and a transport operation of transporting the medium in a transport direction. When the confirmation image is printed, the pixels in which the background dots are formed on the color dots and the pixels in which the color dots are formed on the background dots may be allowed to coexist in an area in which the color image and the background image overlap each other by overlapping positions of the nozzles of the first nozzle line ejecting the ink in the transport direction and positions of the nozzles of the second nozzle line ejecting the ink in the transport direction in the dot forming operation and by repeating the dot forming operation of moving the first and second nozzle lines in a forward direction of the movement direction and the dot forming operation of moving the first and second nozzle lines in a backward direction of the movement direction. Accordingly, it is possible to confirm the confirmation image from both sides.

According to another aspect of the invention, there is provided a printing method of using a printing apparatus which includes a transport unit that transports a transparent medium and winds the medium subjected to printing in a roll shape, a first nozzle line in which a plurality of nozzles ejecting ink to form a color image are arranged, and a second nozzle line in which a plurality of nozzles ejecting ink to form a background image are arranged. The printing method includes: printing a confirmation image formed by overlapping the color image and the background image on an end portion of the medium to be wound in the roll shape so that at least a part of the color image is located on the outside of the background image, when a plurality of printed images to be formed by overlapping the color image and the background image continue to be printed on the medium and when the background image of the printed image is located on the outside of the color image in a case where the medium is wound in the roll shape.

According to the printing method, it is easy to confirm the printed image printed on the medium wound in the roll shape.

Configuration of Apparatus

Figure 2A:
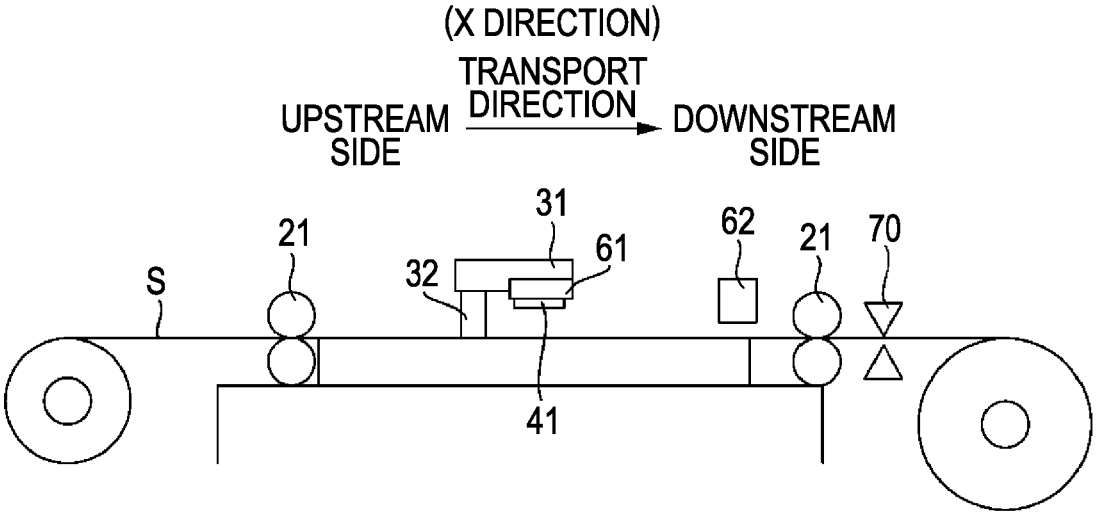
FIG. 2A is a schematic sectional view illustrating the printer.
Figure 2B:
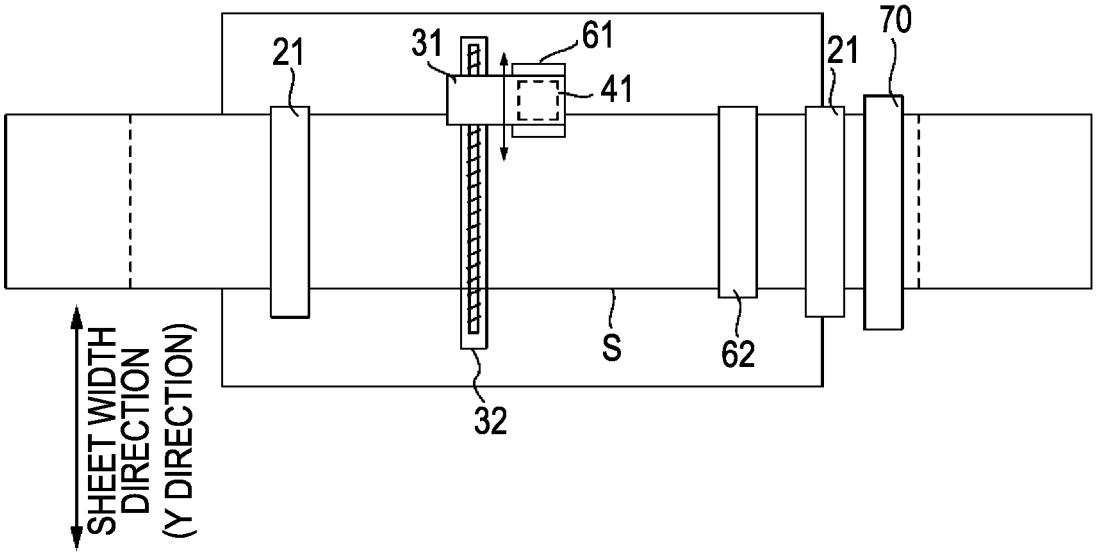
FIG. 2B is a schematic top view illustrating the printer.

FIG. 1 is a block diagram illustrating the overall configuration of a printer 1. FIG. 2A is a schematic sectional view illustrating the printer 1. FIG. 2B is a schematic top view illustrating the printer 1. Hereinafter, an example of a printing system will be described in which an ink jet printer (printer 1) is used as a printing apparatus and the printer 1 and a computer 90 are connected to each other.

A controller 10 is a control unit that controls the printer 1. An interface unit 11 is a unit that transmits and receives data between the computer 90 and the printer 1. A CPU 12 is an arithmetic processing unit that controls the entire printer 1. A memory 13 is a memory that ensures an area for storing a program of the CPU 12 or a working area. The CPU 12 allows a unit control circuit 14 to control each unit. Further, a detector group 50 detects the inside state of the printer 1 and the controller 10 controls each unit based on the detection result.

A transport unit 20 transports a medium S from the upstream side to the downstream side in a direction (transport direction) in which the roll-shaped medium S (such as a roll sheet) is continuous. A transport roller 21 driven by a motor supplies the roll-shaped medium S before printing, and then a winding mechanism winds the medium S subjected to the printing in a roll shape. Further, the medium S can be held at a predetermined position by performing vacuum adsorption on the medium S located in a printing region during the printing.

A carriage unit 30 reciprocates a head in a sheet surface direction. The carriage unit 30 includes a carriage 31 on which the head is mounted and a carriage movement mechanism 32 reciprocating the carriage 31.

A head unit 40 has the head mounted on the carriage 31. A plurality of nozzles that serve as ink ejection portions are formed on the lower surface of the head. In this embodiment, UV ink is ejected from the nozzles. The UV ink is ink that is hardened when being irradiated with ultraviolet light.

An irradiation unit 60 is a unit that irradiates the UV ink ejected on the medium with ultraviolet light. The irradiation unit 60 according to this embodiment includes a tentative hardening irradiation unit 61 and a main hardening irradiation unit 62.

The tentative hardening irradiation unit 61, which is installed in the carriage 31, can be moved together with the head. The tentative hardening irradiation unit 61 emits ultraviolet light with a strength to the extent that the surface of the UV ink is hardened (tentatively hardened) so that the UV ink landed on the medium does not permeate into each other. For example, an LED (Light Emitting Diode) may be used as the tentative hardening irradiation unit 61. The controller 10 allows the tentative hardening irradiation unit 61 to emit the ultraviolet light and tentatively harden the UV ink on the printing region, while moving the carriage 31.

The main hardening irradiation unit 62, which is installed on the downstream side in an X direction of the printing region, can emit the ultraviolet light across the width of the medium. The main hardening irradiation unit 62 emits the ultraviolet light with a strength to the extent that the UV ink on the medium is mainly hardened (completely hardened). For example, a UV lamp is used as the main hardening irradiation unit 62. The controller 10 allows the main hardening irradiation unit 62 to emit the ultraviolet light and harden the image formed with the UV ink, while transporting the medium.

A cutter unit 70 cuts the medium S in the roll shape. The cutter unit 70 is installed on the downstream side of the transport roller 21 located on the downstream side of the printing region in the transport direction.

When the printer 1 performs printing, the printer 1 repeats an operation (pass operation) of moving the carriage 31 in the movement direction and a transport operation. At each pass, the printer 1 ejects ink from the head to form an image on the medium and tentatively hardens the image by allowing the tentative hardening irradiation unit 61 to irradiate the image with the ultraviolet light. The image formed in the printing region is gradually transported toward the main hardening irradiation unit 62 by repeating the pass operation and the transport operation. Then, when the image is transported up to the position facing the main hardening irradiation unit 62, the main hardening irradiation unit 62 irradiates the image with the ultraviolet light to harden the image.

After the necessary number of printed images continues to be printed on the medium S, the transport unit 20 transports the finally printed image up to the downstream side of the cutter unit 70 in the transport direction and the cutter unit 70 cuts the medium S at the position on the upstream side of the finally printed image in the transport direction. The medium S subjected to the printing and cut by the cutter unit 70 is wound in a roll shape by the winding mechanism. The finally printed image is located at the end portion of the medium S subjected to the printing and wound in the roll shape.

In the configuration shown in FIG. 2A, the printed surface faces the outside after the medium S subjected to the printing is unrolled.

Structure of Lower Surface of Carriage

Figure 3:
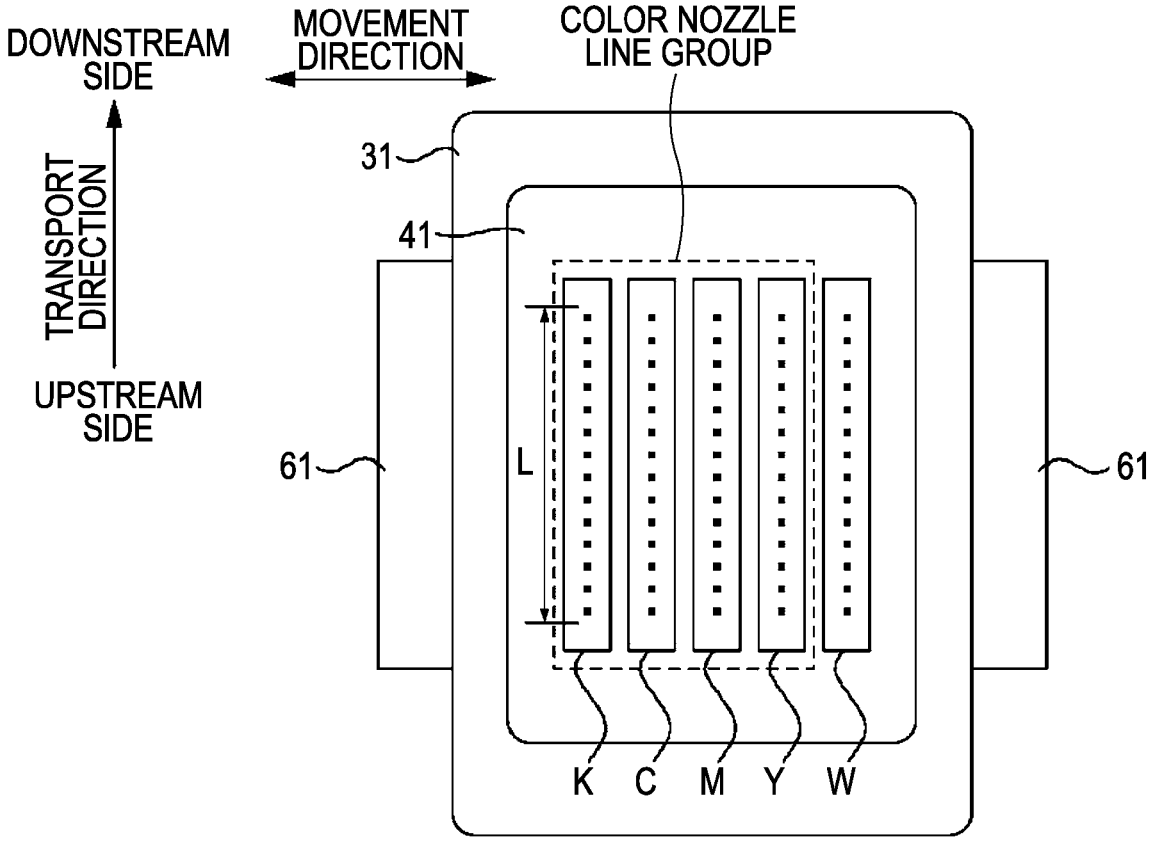
FIG. 3 is a diagram illustrating the lower surface of a carriage.

FIG. 3 is a diagram illustrating the lower surface of the carriage.

A head 41 is installed on the lower surface of the carriage 31. The head 41 includes five nozzle lines. The five nozzle lines include a black nozzle line (K) for ejecting black ink, a cyan nozzle line (C) for ejecting cyan ink, a magenta nozzle line (M) for ejecting magenta ink, a yellow nozzle line (Y) for ejecting yellow ink, and a white nozzle line (W) for ejecting white ink. The black nozzle line, the cyan nozzle line, the magenta nozzle line, and the yellow nozzle line are nozzle lines (color nozzle lines) for ejecting color ink to form a color image. The white nozzle line is a nozzle line for ejecting white ink (background ink) to form a background image.

The white ink is special ink used to form a color image on a transparent medium. When a color image is solely formed on a transparent medium, visibility of the color image is not good. Therefore, by forming a background image with white ink together with the color image, the contrast of the color image is improved or a screening property of the color image is improved, thereby improving the visibility of the color image. Therefore, the white ink is different from the color ink in a using method.

Each nozzle line has 180 nozzles. The 180 nozzles of each nozzle line are arranged at a predetermined pitch in the transport direction. In this embodiment, the nozzles of each nozzle line are arranged at a 1/180 inch interval (that is, L is 1 inch in the drawing). Therefore, whenever the carriage 31 moves once in the movement direction (every pass), a dot line is formed at the 1/180 inch interval in the transport direction by intermittently ejecting the ink from each nozzle line.

Two tentative hardening irradiation units 61 can emit ultraviolet light in irradiation ranges of a width (corresponding to L) of 1 inch in the transport direction. Since the irradiation ranges of the tentative hardening irradiation units 61 and the ink ejection ranges of the respective nozzle lines are arranged in the movement direction, one tentative hardening irradiation unit can irradiate the ink (dots) landed on the medium with the ultraviolet light immediately after the ink is ejected from the nozzle lines to the medium at a given pass.

Reference Description

Interlaced Printing

Figure 4:
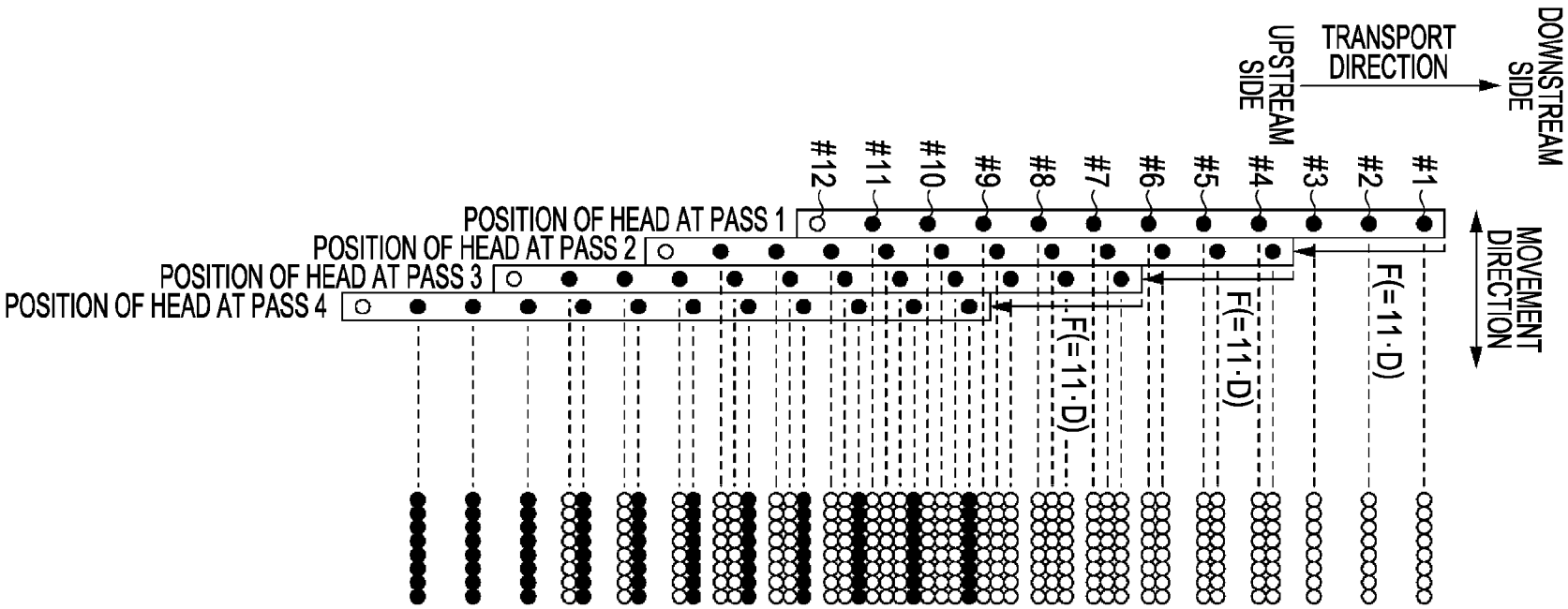
FIG. 4 is a diagram illustrating interlaced printing.

FIG. 4 is a diagram illustrating interlaced printing. FIG. 4 shows the positions of the head (nozzle line) and the dot-formed forms at pass 1 to pass 4.

For facilitating the description, one of the plurality of nozzle lines is illustrated and only a reduced number of nozzles (here, twelve nozzles) is illustrated. The nozzle indicated by a black circle in the drawing is a nozzle that can eject ink. On the other hand, the nozzle indicated by a white circuit is a nozzle that may not eject ink. Further, for facilitating the description, the drawing shows the head (nozzle lines) which is moved relative to the medium. However, the drawing shows the relative position between the head and the medium and the medium is actually transported in the transport direction. Furthermore, for facilitating the description, the drawing shows only several dots (circles in the drawing) formed by each nozzle. However, since ink droplets are intermittently ejected from the nozzle being moved in the movement direction, many dots are actually arranged in the movement direction. The line of the dots is also referred to as a raster line. The dots indicated by the black circle are dots formed at the final pass and the dots indicated by the white circle are dots formed at the previous pass.

The "interlaced printing" means a printing method in which k is 2 or more and a raster line not printed is intervened between raster lines printed at one pass. For example, in the printing method shown in the drawing, three raster lines are intervened between the raster lines formed at one pass.

In the interlaced printing, each nozzle prints the raster line immediately above the raster line printed at the immediately previous pass, whenever the medium is transported by a constant transport amount F in the transport direction. In order to perform the printing at the constant transport amount, the following conditions are set: (1) k and the number of nozzles N (which is an integer) capable of ejecting the ink have a coprime relationship and (2) the transport amount F is set to N·D.

In the drawing, the nozzle line includes twelve nozzles arranged in the transport direction. The nozzle pitch k of the nozzle line is 4. Therefore, since the condition that "N and k have the coprime relationship" is satisfied as the condition for performing the interlaced printing, not all of the nozzles are used, but eleven nozzles (nozzle #1 to nozzle #11) are used. Further, since the eleven nozzles are used, the medium is transported by a transport amount 11·D. As a consequence, the dots are formed at the dot interval of 720 dpi (=D) using the nozzle line with the nozzle pitch of 180 dpi (4·D). When the interlaced printing is performed by the nozzle line including the 180 nozzles, the pass operation of 179 nozzles and the transport operation of a transport amount of 179·D are alternately repeated.

In the interlaced printing, the pass operation has to be performed k times to complete the raster line in which the nozzle pitch widths are continuous. For example, the pass operation has to be performed four times to complete four continuous raster lines at the dot interval of 720 dpi by the use of the nozzle line with the nozzle pitch of 180 dpi. In the drawing, the continuous raster lines are formed at the dot interval D on the upstream side of the raster line (which is a raster line indicated by the arrow in the drawing) formed by the nozzle #3 at pass 3 in the transport direction.

When the color image is formed by the interlaced printing without forming a background image, the color nozzle lines (the cyan nozzle line, the magenta nozzle line, the yellow nozzle line, and the black nozzle line) of the respective colors operate as in FIG. 4. That is, the color nozzle lines of the colors eject the ink from the nozzles #1 to #11 (the nozzles #1 to #179 when each nozzle line includes 180 nozzles). In this case, the positions of the nozzles in the transport direction of the nozzles ejecting the ink overlap each other in the color nozzle lines of the respective colors. For example, the positions of the nozzles in the transport direction of the nozzles ejecting the cyan ink overlap the positions of the nozzles in the transport direction of the nozzle ejecting the magenta ink.

However, the supposition has not hitherto been described in which the positions of the color nozzles in the transport direction of the color nozzles ejecting the color ink overlap the positions of the white nozzles in the transport direction of the white nozzles ejecting the white ink when a color image is formed while a background image is formed. In the above description, when a color image is formed while a background image is formed, the positions of the color nozzles in the transport direction of the color nozzles ejecting the color ink are configured not to overlap the positions of the white nozzles in the transport direction of the white nozzles ejecting the white ink, as described below in front printing and rear printing.

Overlap Printing

Figure 5A:
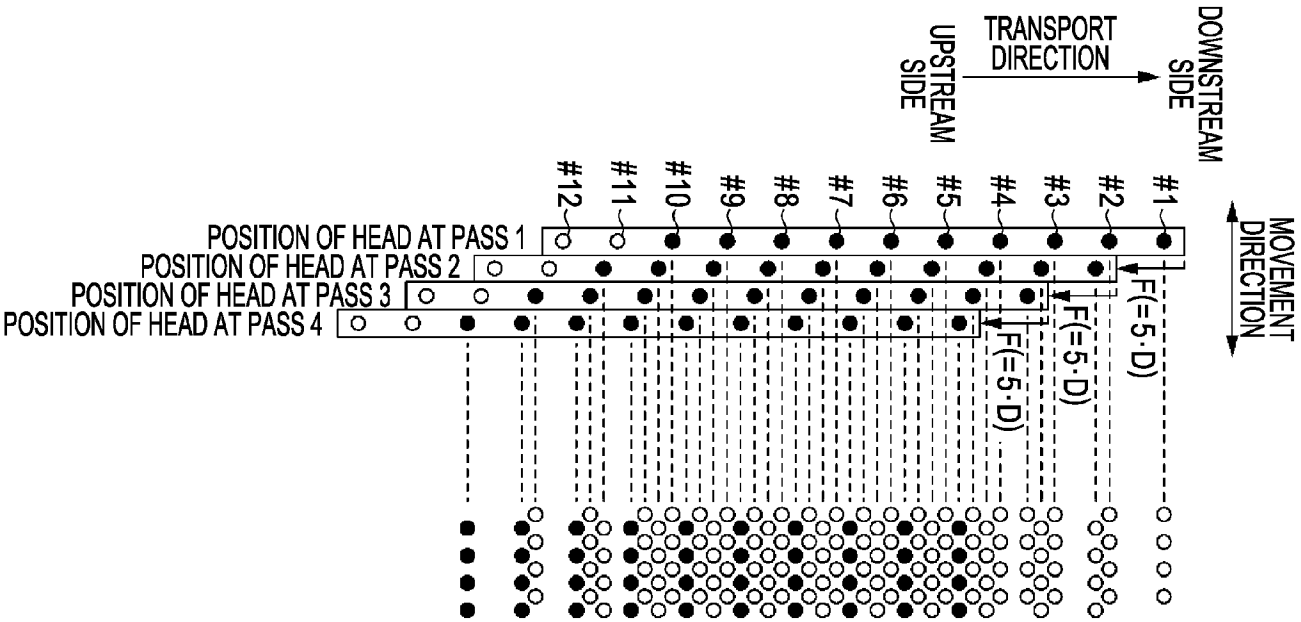
FIGS. 5A and 5B are diagrams illustrating overlap printing.
Figure 5B:
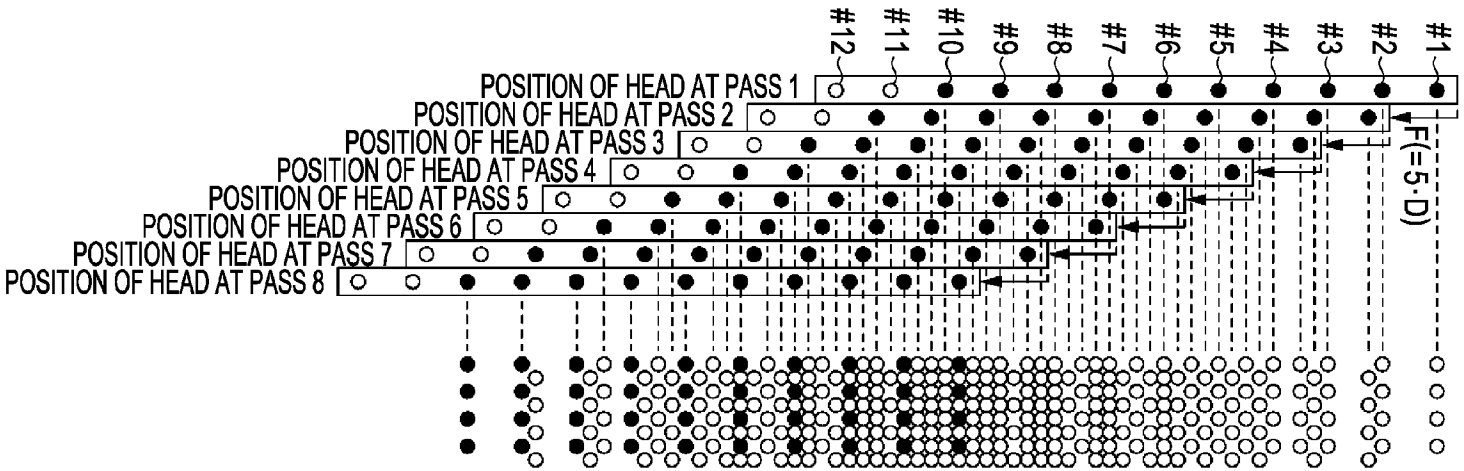

FIGS. 5A and 5B are diagrams illustrating overlap printing. FIG. 5A is a diagram illustrating the positions of the head and the forms of dots at pass 1 to pass 4 and FIG. 5B is the diagram illustrating the positions of the head and the forms of dots at pass 1 to pass 8.

The "overlap printing" means a printing method of forming a raster line using the plurality of nozzles. For example, each raster line is formed by two nozzles in the printing method shown in FIGS. 5A and 5B.

In the overlap printing, the respective nozzles form the dots at an interval of several dots whenever the medium is transported by the constant transport amount F in the transport direction. Then, at another pass, the different nozzles form dots between the dots formed at the interval to supplement the interval of several dots (fill the gap between the dots), so that the plurality of nozzles form one raster line. When one raster line is formed by the passes of M times, the "overlap number M" is defined.

In FIGS. 5A and 5B, the dots are formed at odd pixels or even pixels every pass, since the respective nozzles form the dots at the interval of one dot. Since one raster line is formed by two nozzles, the overlap number M is equal to 2.

In the overlap printing, since the printing is performed at a constant transport amount, the following conditions are set: (1) N/M is an integer, (2) N/M and k have a coprime relationship, and (3) the transport amount F is set to (N/M)·D.

In FIGS. 5A and 5B, the nozzle line includes twelve nozzles arranged in the transport direction. Here, since the nozzle pitch of the nozzle line is 4, all of the nozzles may not be used to satisfy the "coprime relationship between N/M and k" which is the condition for performing the overlap printing. Therefore, the overlap printing is performed using ten nozzles among the twelve nozzles. Further, the medium is transported by a transport amount 5·D since the ten nozzles are used. As a consequence, for example, the dots are formed on the medium at the dot interval of 720 dpi (=D) using the nozzle line with the nozzle pitch of 180 dpi (4·D).

When one raster line is formed by M nozzles, it is necessary to perform the pass operation k×M times in order to complete the raster line corresponding to the nozzle pitch. For example, since one raster line is formed by two nozzles in FIGS. 5A and 5B, it is necessary to perform the pass operation eight times in order to complete four raster lines. In the drawings, continuous raster lines are formed at the dot interval D on the upstream side of the raster lines formed by the nozzle #9 at pass 1 and the nozzle #4 at pass 5 in the transport direction.

In FIGS. 5A and 5B, the respective nozzles form dots in the odd pixels at pass 1, the respective nozzles form dots in the even pixels at pass 2, the respective nozzles form dots in the odd pixels at pass 3, and the respective nozzles form dots in the even pixels at pass 4. That is, the dots are formed in the order of the odd pixels, the even pixels, the odd pixels, and the even pixels at the four passes of the first half. Then, at four passes (pass 5 to pass 8) of the second half, the dots are formed in the reverse order to the order of the four passes of the first half. That is, the dots are formed in the order of the even pixels, the odd pixels, the even pixels, and the odd pixels. Further, the formation order of the dots subsequent to pass 9 is the same as the formation order of the dots from pass 1.

Front Printing and Rear Printing

Figure 6A:
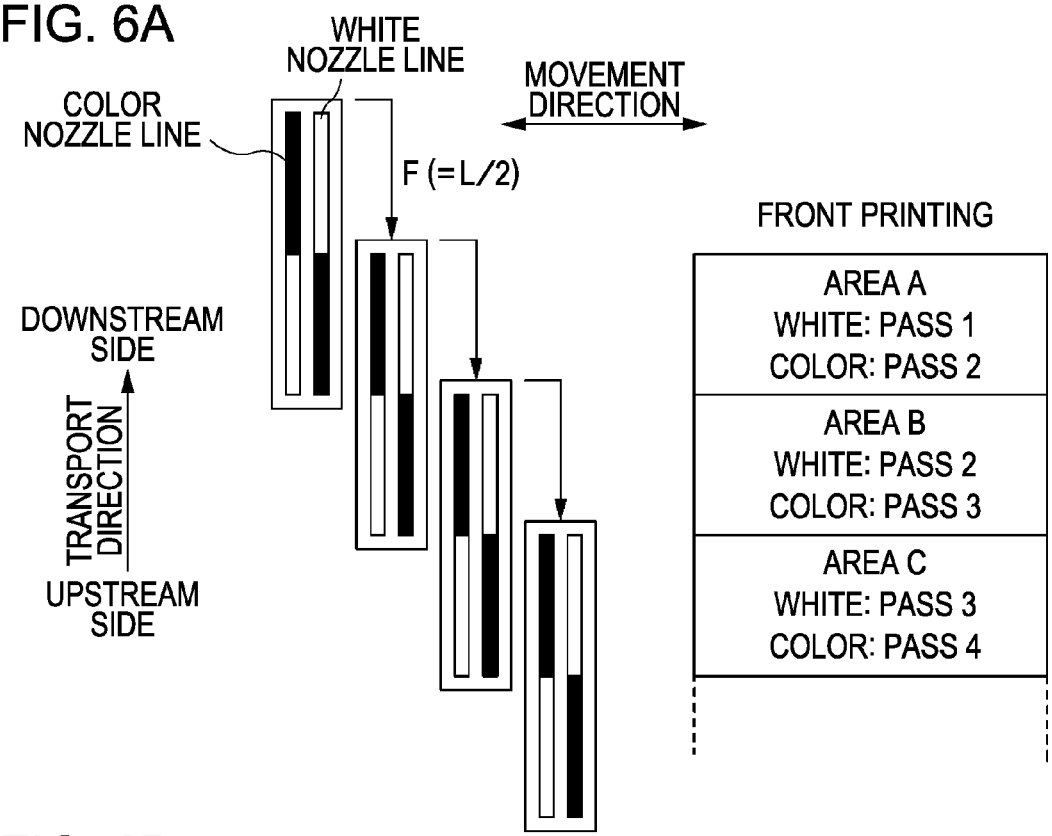
FIG. 6A is a diagram illustrating front printing.
Figure 7A:
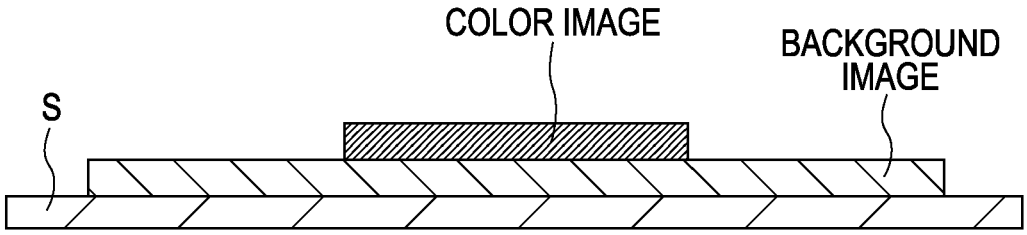
FIG. 7A is a diagram illustrating an image formed by the front printing.

FIG. 6A is a diagram illustrating the front printing. FIG. 7A is a diagram illustrating a printed image formed by the front printing. The "front printing" refers to printing by which a background image is formed on a medium and a color image is then formed on the background image.

When the front printing is performed, the nozzles (nozzles #1 to #90) of the half of the color nozzle line (for example, the cyan nozzle line) on the downstream side in the transport direction are used and the nozzles (nozzles #91 to #180) of the half of the white nozzle line on the upstream side in the transport direction are used in the white nozzle line. The color image is formed on the background image formed with the white ink by alternately repeating the transport operation and the pass operation of using the nozzles in this way. In an area A shown in the drawing, for example, the color image is formed on the background image by forming the background image at pass 1, and then forming the color image on the background image at pass 2.

Figure 6B:
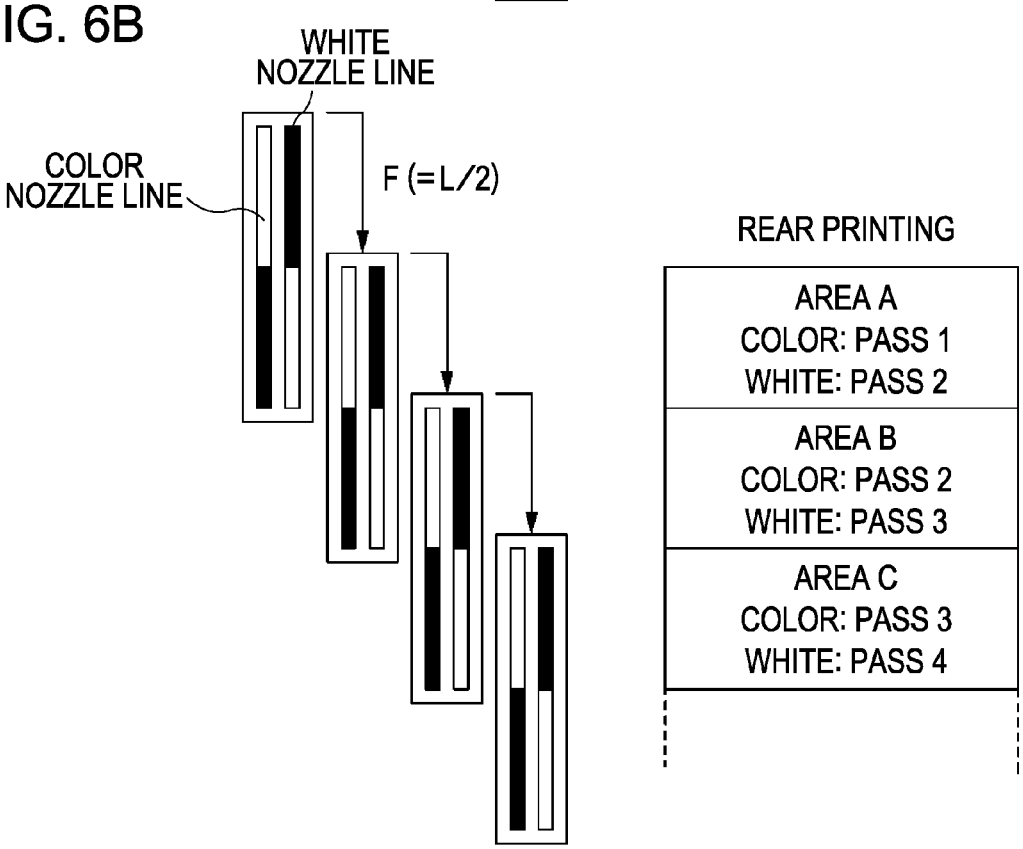
FIG. 6B is a diagram illustrating rear printing.
Figure 7B:
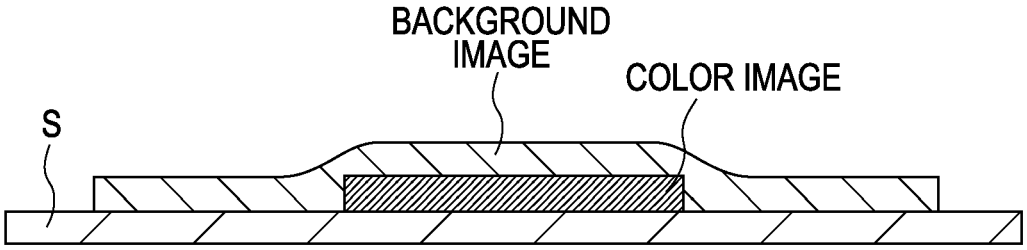
FIG. 7B is a diagram illustrating an image formed by the rear printing.

FIG. 6B is a diagram illustrating the rear printing. FIG. 7B is a diagram illustrating the printed image formed by the rear printing. The "rear printing" refers to printing by which a color image is formed and a background image is then formed on the color image. The rear printing is performed mainly on a transparent medium and the color image of the printed matter printed by the rear printing is viewed over the transparent medium.

When the rear printing is performed, the nozzles (nozzles #91 to #180) of the half of the color nozzle line on the upstream side in the transport direction are used and the nozzles (nozzles #1 to #90) of the half of the white nozzle on the downstream side in the transport direction are used. The background image is formed on the color image formed by alternately repeating the transport operation and the pass operation of using the nozzles in this way. In the area A shown in the drawing, for example, the background image is formed on the color image by forming the color image at pass 1, and then forming the background image on the background image at pass 2.

Figure 8:
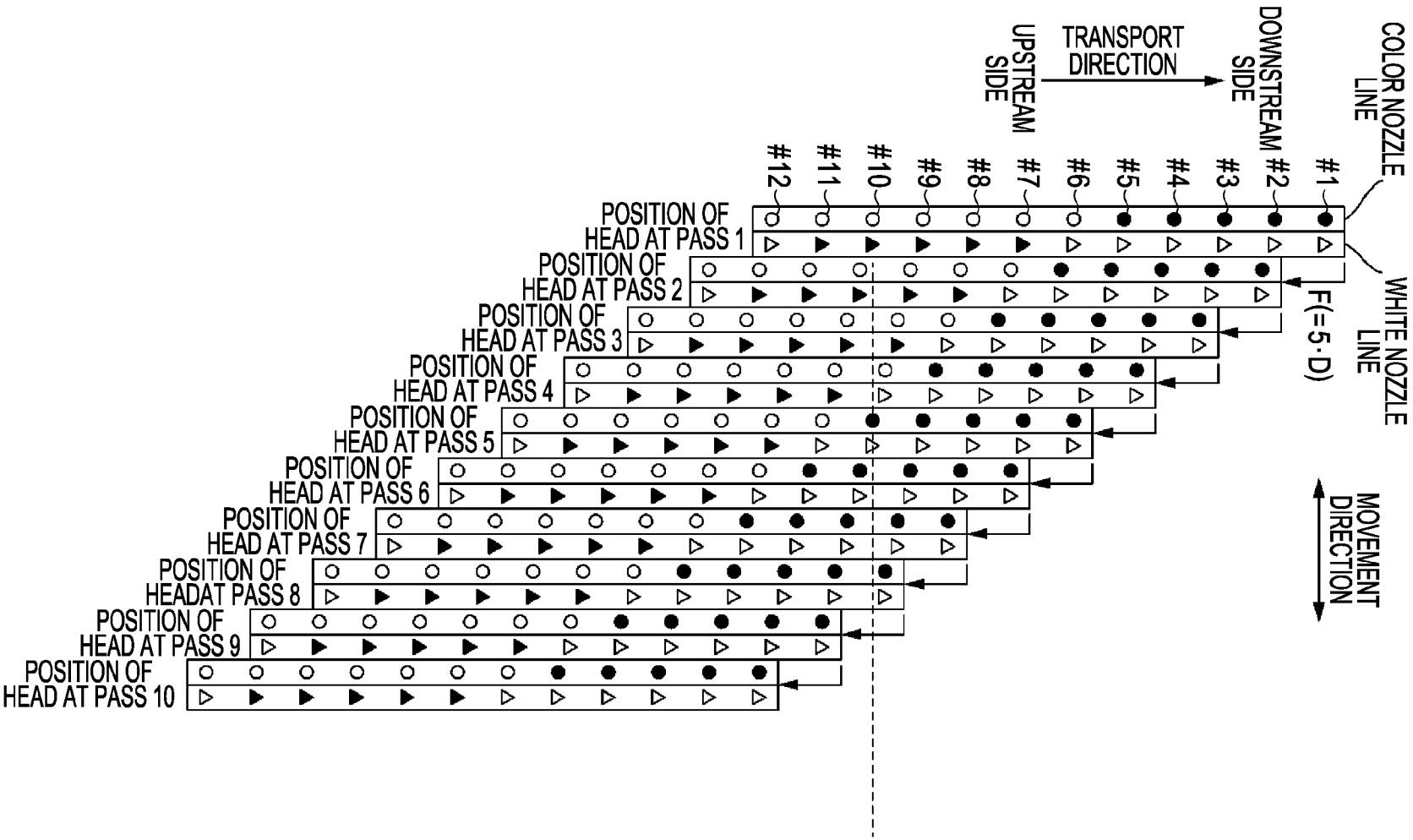
FIG. 8 is a diagram illustrating the front printing of the interlaced printing.

FIG. 8 is a diagram illustrating the front printing of the interlaced printing. In the drawing, the nozzles of the color nozzle line are indicated by a circle and the nozzles of the white nozzle line are indicated by a triangle. Here, the front printing will be described. The rear printing will not be described.

In the front printing of the interlaced printing, the nozzles (nozzles #1 to #6) of the half of the color nozzle line of the color nozzle group on the downstream side in the transport direction are used and the nozzles (nozzles #7 to #12) of the half of the white nozzle line on the upstream side in the transport direction are used. The ink is ejected from five nozzles and the medium is transported by the transport amount 5·D, when the interlaced printing is performed using six nozzles to satisfy the conditions (that is, (1) k and the number of nozzles N (which is an integer) capable of ejecting the ink have a coprime relationship and (2) the transport amount F is set to N·D) of the above-described interlaced printing.

In the position of any raster line, the white dots are formed by the nozzles (white nozzles) of the white nozzle line, and then the color dots are formed by the nozzles (color nozzles) of the color nozzle line. For example, in the raster line located in the dotted line in the drawing, the white dots are formed at pass 1, and then the color dots are formed at pass 5. Therefore, the color image can be formed on the background image.

Although description is not made here, the front printing or the rear printing can be performed by the above-described overlap printing.

COMPARISON EXAMPLE

Figure 9A:
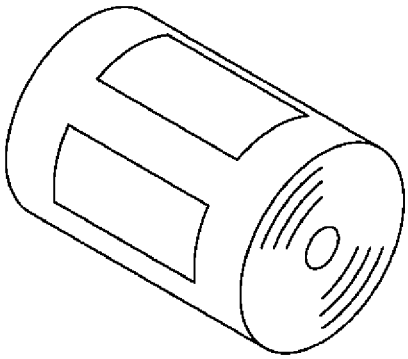
FIGS. 9A and 9B are diagrams according to a comparison example.
Figure 9B:
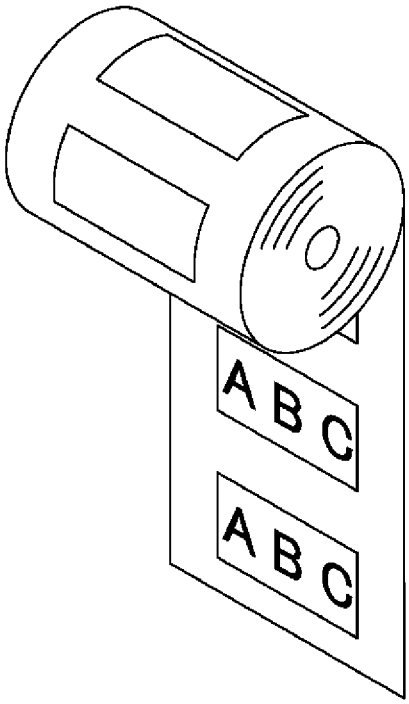

FIGS. 9A and 9B are diagrams illustrating a comparison example. FIG. 9A is a diagram illustrating the medium S subjected to the printing and wound in a roll shape. FIG. 9B is a diagram illustrating the medium S shown in FIG. 9A which is partially unrolled.

As described above, the printer 1 continues to print the necessary number of printed images on the medium S and the cutter unit 70 cuts the position of the finally printed image on the upstream side in the transport direction. Then, the medium S subjected to the printing and cut by the cutter unit 70 is wound by the winding mechanism to enter the state shown in FIG. 9A.

When the medium S subjected to the front printing or the rear printing is wound in the roll shape, the color image is hidden behind the background image in some cases. For example, the color image is hidden behind the background image, as shown in FIG. 9A, when the printed image printed by the front printing in FIG. 7A is wound in the roll shape and the background image is located in the outside of the color image or when the printed image printed by the rear printing in FIG. 7B is wound in the roll shape and the background image is located on the outside of the color image.

In the state shown in FIG. 9A, it is difficult for an operator to confirm which image is printed on the medium S subjected to the printing. Therefore, it is necessary to temporarily unroll the medium S wound in the roll shape, as shown in FIG. 9B, when an operator confirms the printed image.

First Embodiment

Figure 10:
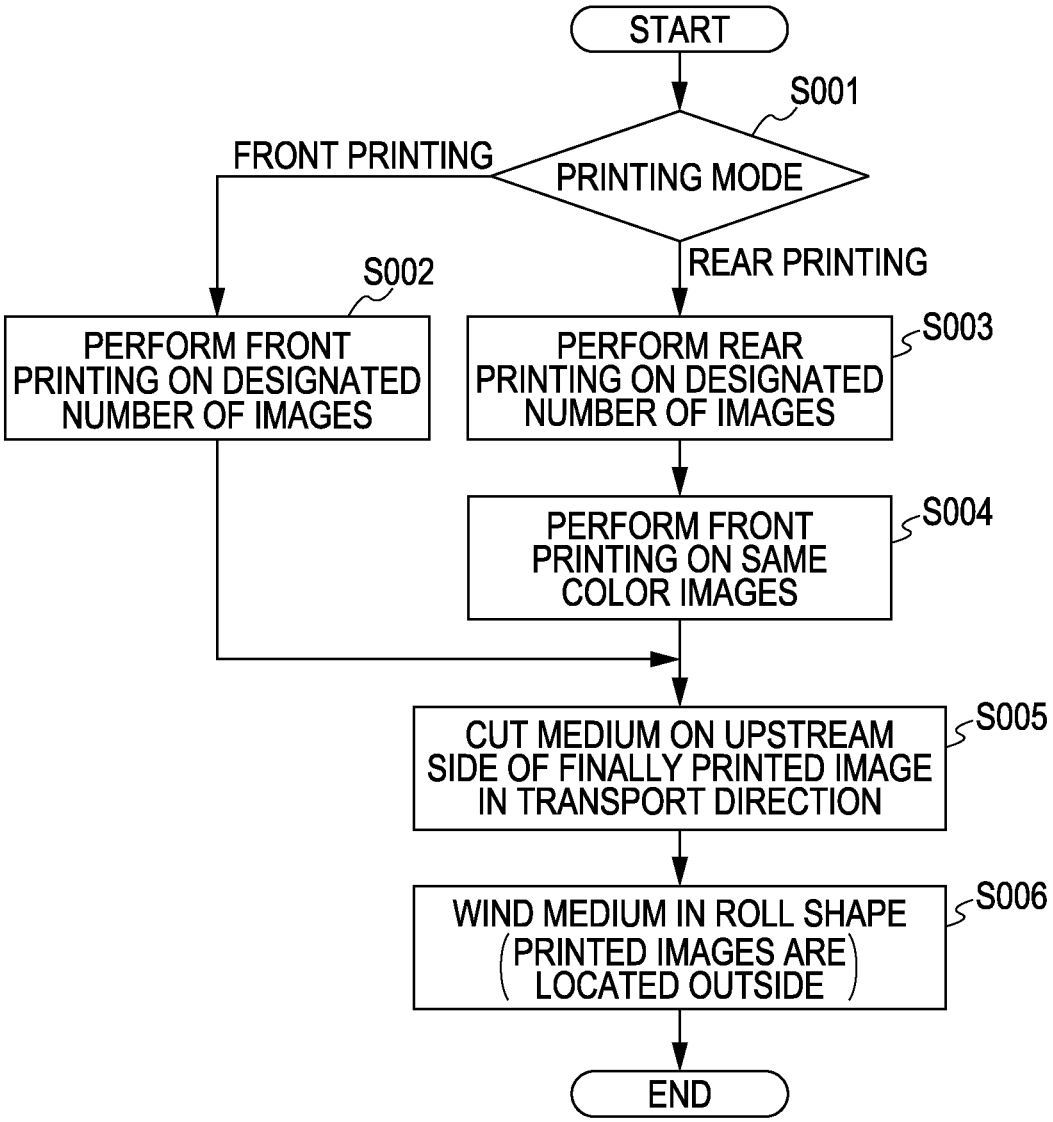
FIG. 10 is a flowchart illustrating printing according to a first embodiment.

FIG. 10 is a flowchart illustrating printing according to a first embodiment. The printing in FIG. 10 is performed when a background image and a color image are printed on a transparent medium S in an overlapping manner. In the first embodiment, the description will be made on the supposition that a printed surface of the wound medium S faces the outside, as shown in FIG. 2A.

First, the controller 10 determines whether a printing mode is the front printing or the rear printing (S001). In the case of the front printing, there is no problem (see FIG. 9A) that the color image is hidden behind the background image even when the medium S subjected to the printing is wound. Therefore, when the printing mode is the front printing, the controller 10 controls each unit such that the designated number of images continues to be subjected to the front printing (S002), the cutter unit 70 cuts the medium S on the upstream side of the finally printed image in the transport direction (S005), and then the winding mechanism winds the medium S subjected to the printing in the roll shape (S006).

When the printing mode is the rear printing, the color image may be hidden behind the background image (see FIG. 9A), when the designated number of images is just subjected to the rear printing and the medium S subjected to the printing is wound. For this reason, when the printing mode is the rear printing, the controller 10 controls each unit such that the designated number of images is subjected to the rear printing (S003) and the same color image as the color image formed in S003 is then subjected to the front printing (S004). That is, the finally printed image which is a confirmation image is subjected not to the rear printing but to the front printing. Thereafter, as in the front printing, the controller 10 allows the cutter unit 70 to cut the medium S on the upstream side of the finally printed image in the transport direction (S005), and then allows the winding mechanism to wind the medium S subjected to the printing in the roll shape (S006).

Figure 11A:
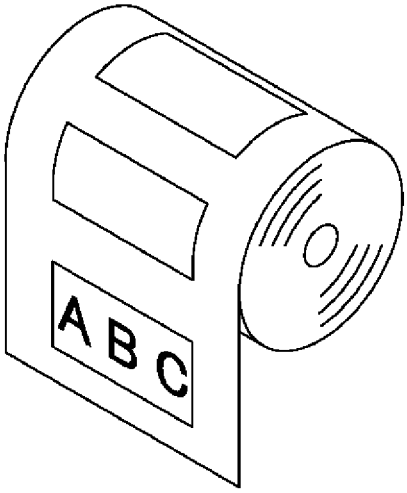
FIGS. 11A and 11B are diagrams illustrating a medium S subjected to the printing according to the first embodiment.
Figure 11B:
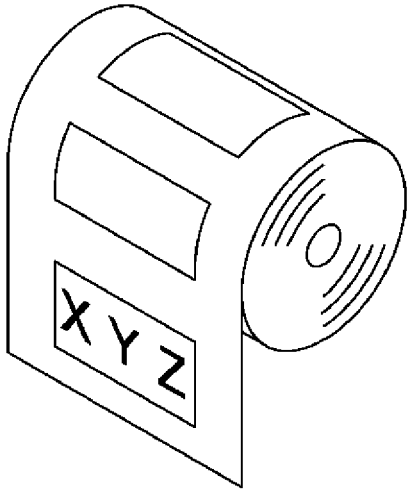

FIGS. 11A and 11B are diagrams illustrating the medium S subjected to the printing according to the first embodiment. A part of the medium S is unrolled slightly to show three printed images. However, the medium S may, of course, not be unrolled.

In the first embodiment, since the printed surface of the wound medium S faces the outside, the background image is located on the outside of the color image in the printed image (printed image other than the confirmation image) subjected to the rear printing and the color image is hidden behind the background image. In the first embodiment, however, since the finally printed image which is the confirmation image is subjected to the front printing, the color image is located on the outside of the background image in the confirmation image when the medium S is wound. Therefore, the operator can easily confirm which image is printed on the medium S subjected to the printing, even when the medium S subjected to the printing is wound (even when the medium S may not be unrolled). For example, the operator can recognize that the color image hidden behind the background image is characters "ABC" when viewing the medium shown in FIG. 11A. Further, the operator can recognize that the color image hidden behind the background image is characters "XYZ" when viewing the medium shown in FIG. 11B.

Second Embodiment

Figure 12:
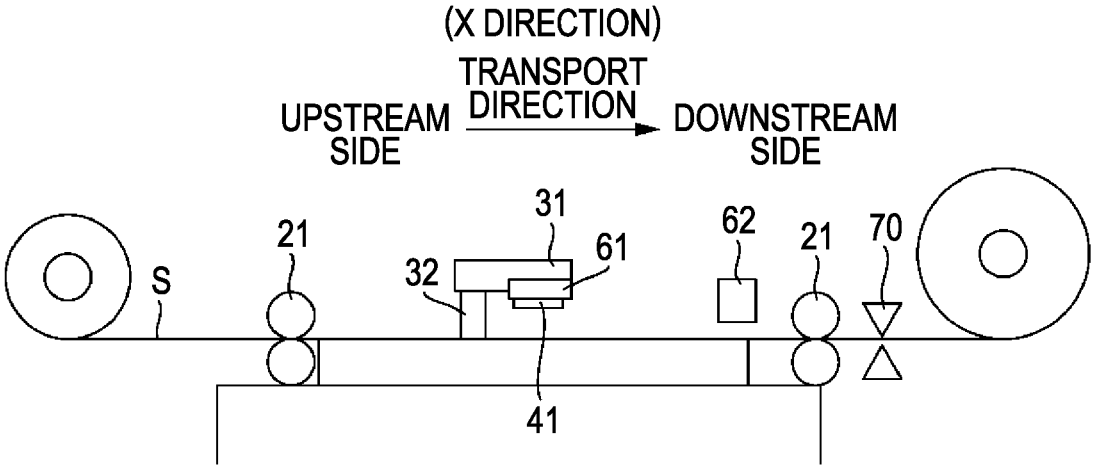
FIG. 12 is a schematic sectional view illustrating a printer according to a second embodiment.

FIG. 12 is a schematic sectional view illustrating the printer 1 according to a second embodiment. Compared to the first embodiment shown in FIG. 2A, the printed surface of the wound medium S faces not the outside but the inside according to the second embodiment.

Figure 13:
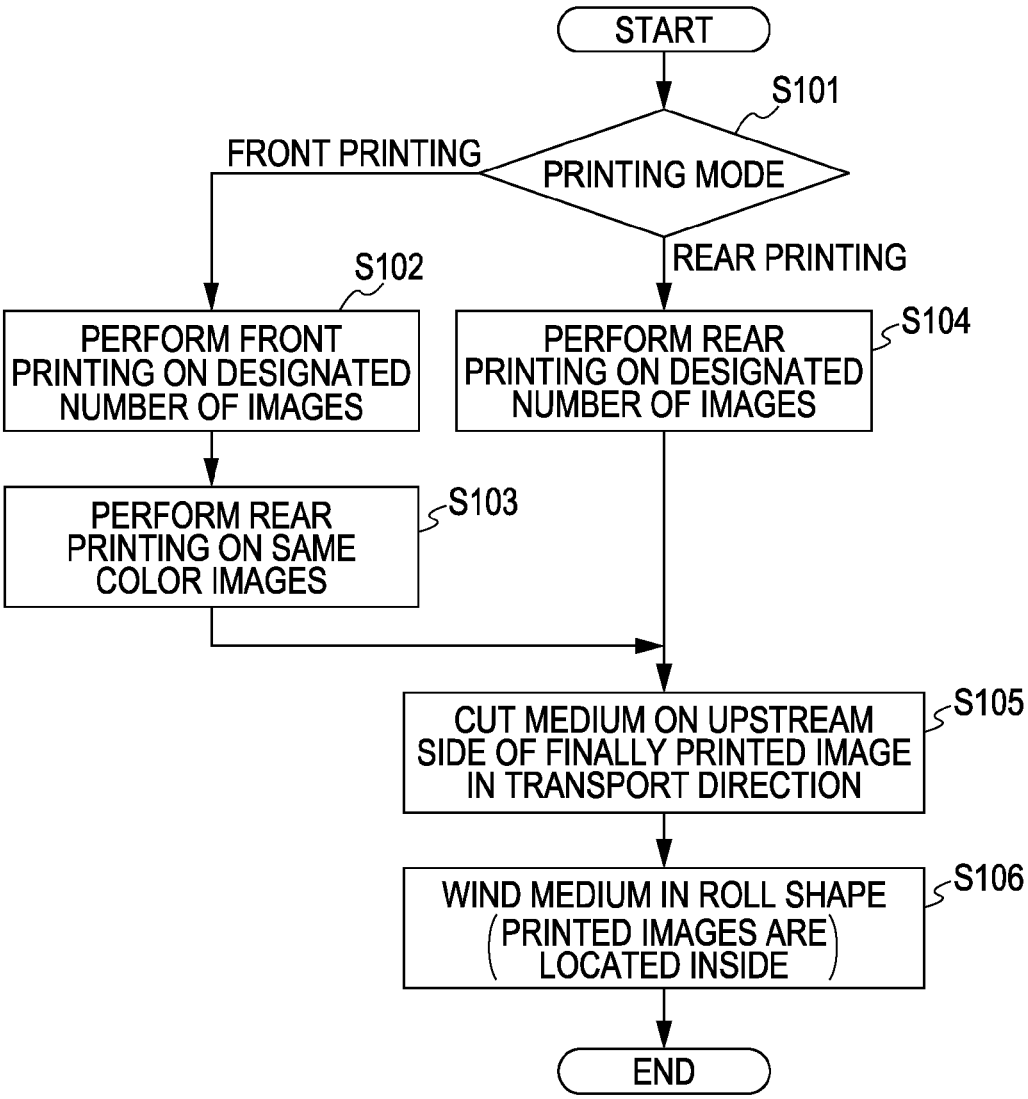
FIG. 13 is a flowchart illustrating the printing according to the second embodiment.

FIG. 13 is a flowchart illustrating printing according to the second embodiment. The printing in FIG. 13 is performed when a background image and a color image are printed on a transparent medium S in an overlapping manner.

First, the controller 10 determines whether the printing mode is the front printing or the rear printing (S101). In the second embodiment, the printed surface of the wound medium S faces the inside. Therefore, when the front printing is performed, the problem may arise in that the color image is hidden behind the background image. For this reason, when the printing mode is the front printing, the controller 10 controls each unit such that the designated number of images is subjected to the front printing (S102) and the same color image as the color image formed in S102 is then subjected to the rear printing (S103). That is, the finally printed image which is a confirmation image is subjected not to the front printing but to the rear printing. Then, the controller 10 allows the cutter unit 70 to cut the medium S on the upstream side of the finally printed image in the transport direction (S105), and then allows the winding mechanism to wind the medium S subjected to the printing in the roll shape (S106).

On the other hand, in the case of the rear printing, there is no problem (see FIG. 9A) that the color image is hidden behind the background image even when the medium S subjected to the printing is wound. Therefore, when the printing mode is the rear printing, the controller 10 controls each unit such that the designated number of images continues to be subjected to the rear printing (S104), the cutter unit 70 cuts the medium S on the upstream side of the finally printed image in the transport direction (S105), and then the winding mechanism winds the medium S subjected to the printing in the roll shape (S106).

In the second embodiment, since the printed surface of the wound medium S faces the inside, the background image is located on the outside of the color image and the color image is hidden behind the background image in the printed image subjected to the front printing. In the second embodiment, however, since the finally printed image which is the confirmation image is subjected to the rear printing (S103), the color image is located on the outside of the background image in the confirmation image when the medium S is wound. Therefore, the operator can easily confirm which image is printed on the medium S subjected to the printing, even when the medium S subjected to the printing is wound.

Third Embodiment

In the confirmation image according to the first and second embodiments described above, all of the color images are located on the outside of the background image. However, as long as the color image which is the confirmation image can be recognized from the outside of the medium wound in the roll shape, a part of the color image which is the confirmation image may be located on the outside of the background image.

Figure 14:
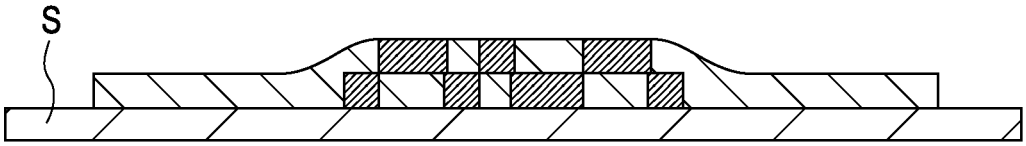
FIG. 14 is a diagram illustrating a formed image according to a third embodiment.

FIG. 14 is a diagram illustrating an image formed according to a third embodiment. Compared to the printed image formed by the front printing in FIG. 7A or the printed image formed by the rear printing in FIG. 7B, the printed image formed in the third embodiment is different in that the pixels at which white dots are formed on the color dots and the pixels at which the color dots are formed on the white dots coexist in the region where the color image and the background image overlap each other. Thus, even when the background image is printed, it is easy to view the color image from both surfaces of the medium.

Figure 15:
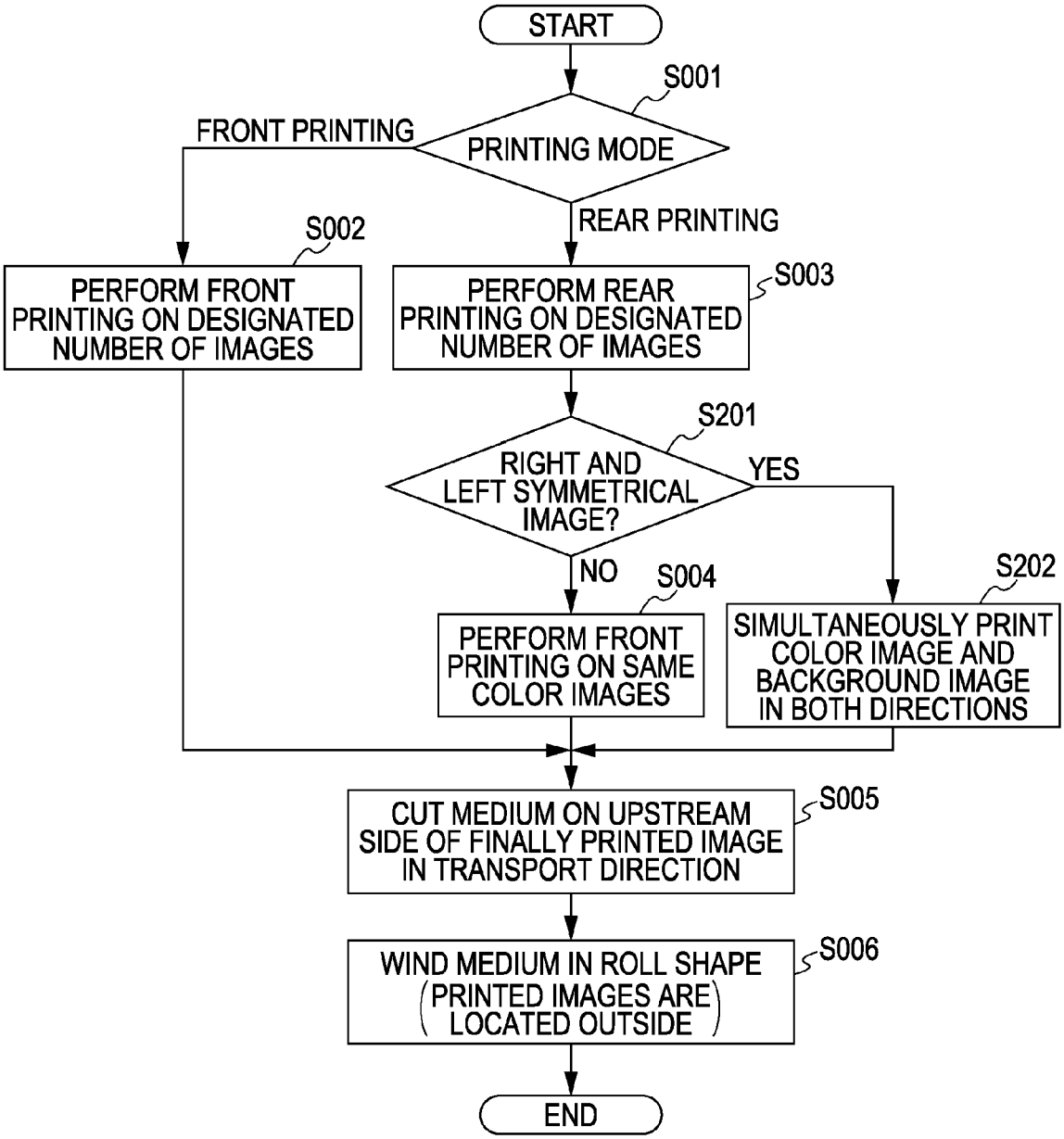
FIG. 15 is a flowchart illustrating the printing according to the third embodiment.

FIG. 15 is a flowchart illustrating printing according to the third embodiment. Here, as in the first embodiment, the description will be made on the supposition that the printed surface of the wound medium S faces the outside (see FIG. 2A). In the process common to the printing of the first embodiment, the same reference numerals are given in the drawing and the description thereof will not be repeated. Compared to the printing (see FIG. 10) according to the first embodiment, the printing according to the third embodiment is different in that processes of S201 and S202 are inserted.

In the third embodiment, when the printing mode is the rear printing, the controller 10 controls each unit such that the designated number of images is subjected to the rear printing (S003), and then determines whether the printed image is a right and left symmetrical image (S201). When the printed image is not the right and left symmetrical image (NO in S201), the controller 10 performs the front printing on the same color image as the color image formed in S003 as in the first embodiment (S004).

When the printed image is the right and left symmetrical image (YES in S201), the controller 10 performs a printing method described below.

Figure 16:
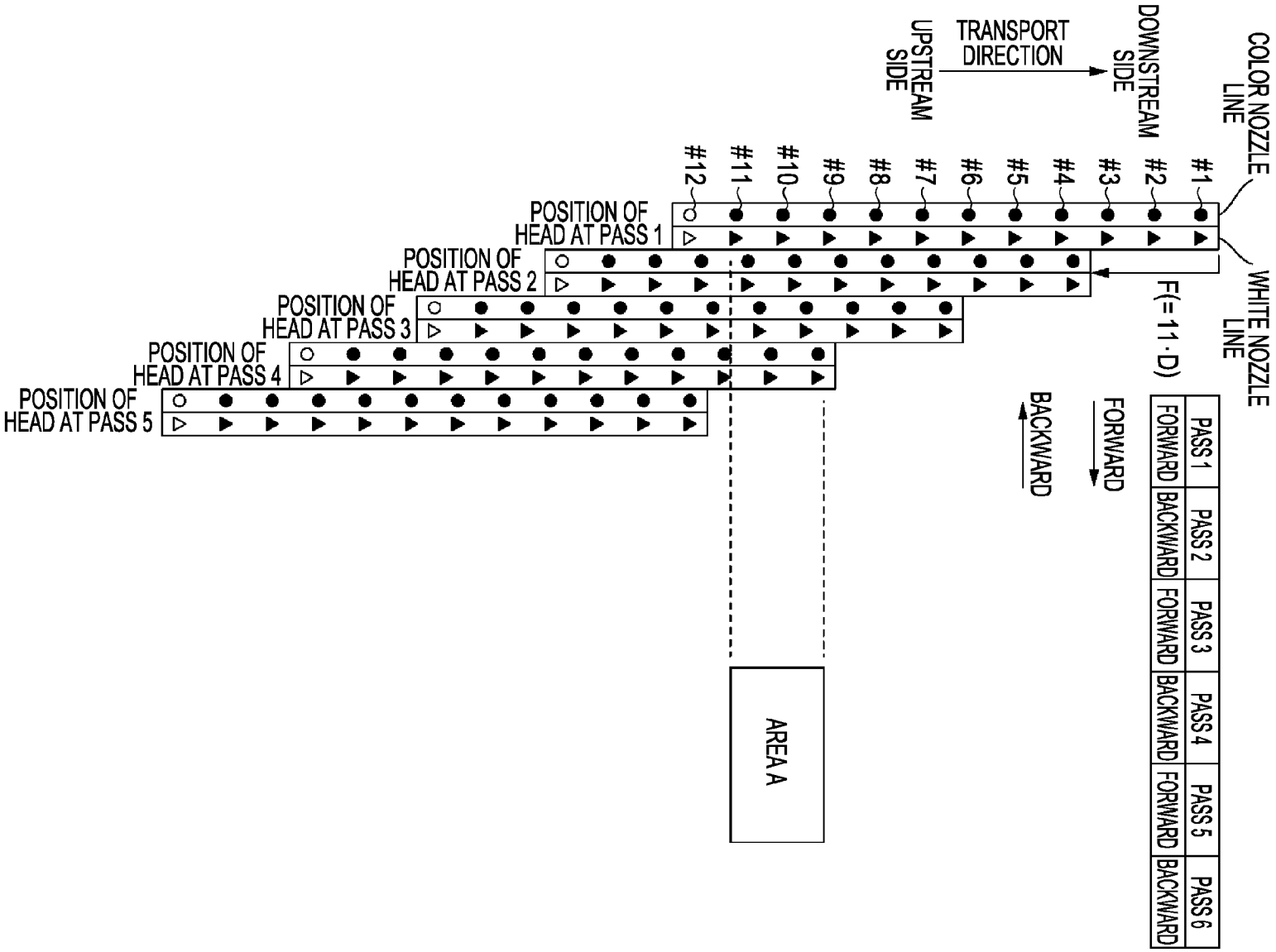
FIG. 16 is a diagram illustrating a printing method in S202 of the third embodiment.

FIG. 16 is a diagram illustrating the printing method performed in S202 according to the third embodiment. When the respective operations of the color nozzle line and the white nozzle line are focused, the interlaced printing in FIG. 4 is performed in both the operations.

In the front printing or the rear printing described above, the positions of the color nozzles ejecting the color ink in the transport direction are configured not to overlap the positions of the white nozzles ejecting the white ink in the transport direction (see FIGS. 6A, 6B, and 8). In the printing method shown in FIG. 16, however, the positions of the color nozzles (nozzles #1 to #11) ejecting the color ink in the transport direction overlap the positions of the white nozzles (nozzles #1 to #11) ejecting the white ink in the transport direction. Therefore, many nozzles eject the ink and the transport amount is consequently increased.

In this embodiment, bidirectional printing is performed. As shown in the drawing, the carriage moves forward at the odd passes (pass 1, pass, 3, and the like) and the carriage moves backward at the even passes (pass 2, pass 4, and the like).

Figure 17A:
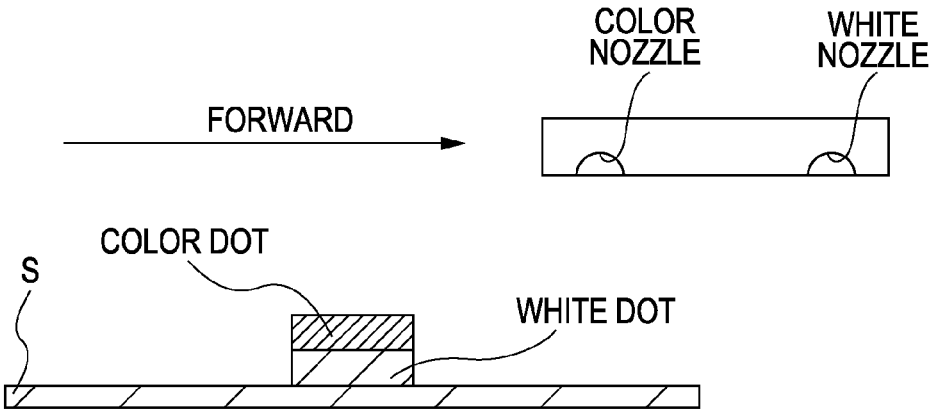
FIGS. 17A and 17B are diagrams illustrating a front and rear relationship between color dots and white dots in bidirectional printing.
Figure 17B:
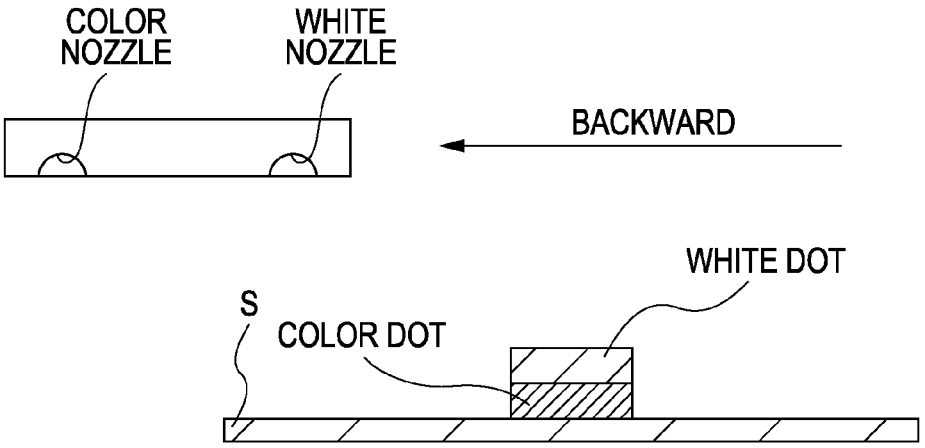

FIGS. 17A and 17B are diagrams illustrating a front and rear relationship between the color dots and the white dots in the bidirectional printing. As shown in FIG. 17A, the color dots are formed on the white dots at the passes (odd passes) at which the carriage moves forward, since the white nozzles are located on the downstream side in the movement direction of the carriage with respect to the color nozzles. On the other hand, as shown in FIG. 17B, the white dots are formed on the color dots at the passes (even passes) at which the carriage moves backward, since the color nozzles are located on the downstream side in the movement direction of the carriage with respect to the white nozzles.

Figure 18A:
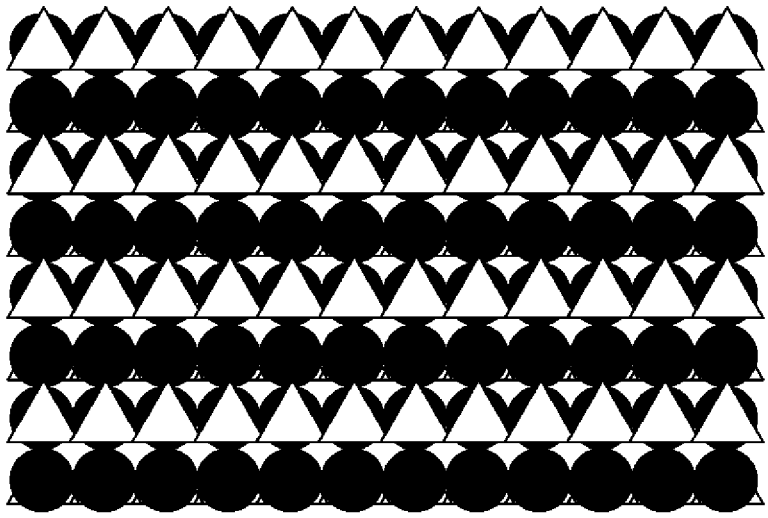
FIGS. 18A and 18B are diagrams illustrating the shapes of dots of eight raster lines in an area A of FIG. 16.
Figure 18B:
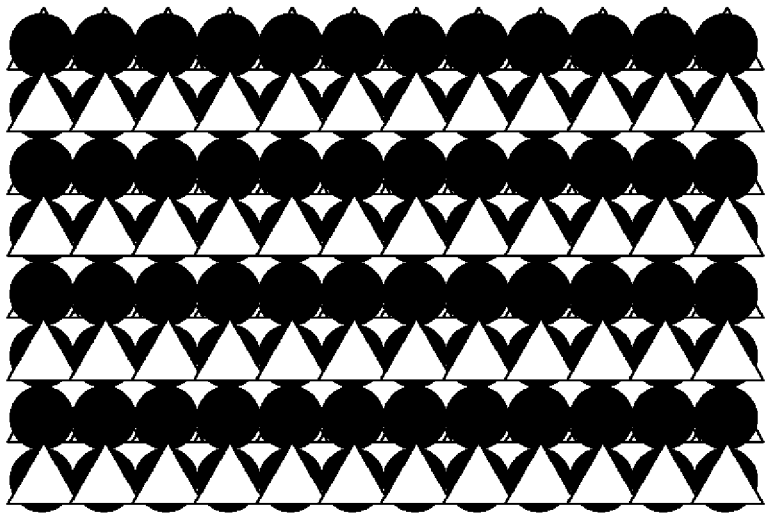

FIGS. 18A and 18B are diagrams illustrating the shapes of dots of eight raster lines in the area A of FIG. 16. FIG. 18A is the diagram illustrating the shapes of the dots viewed from the front side and FIG. 18B is the diagram illustrating the shape of the dots viewed from the rear side. In the drawings, a color dot is indicated by a black circle and a white dot is indicated by a white triangle. A top and bottom relationship between the color dot and the white dot is indicated by a top and bottom relationship between the black circle and the white triangle.

Here, for facilitating the description, the color dots and the white dots are formed in all of the pixels.

Since the even raster lines from the upper side of the area A are formed in the forward movement of the carriage, the color dots are formed on the white dots. For example, since the second raster line is formed from the upper side of the area A by the nozzle #4 at pass 3 at which the carriage moves forward (see FIG. 16), the color dots are formed on the white dots. Therefore, in the even raster lines from the upper side of the area A, it is easy to view the color dots and it is difficult to view the white dots due to the fact that the white dots are hidden behind the color dots, when the color dots and the white dots are viewed from the front side. On the contrary, it is easy to view the white dots and it is difficult to view the color dots due to the fact that the color dots are hidden behind the white dots, when the white dots and the color dots are viewed from the rear side.

On the other hand, since the odd raster lines from the upper side of the area A are formed in the backward movement of the carriage, the white dots are formed on the color dots. For example, since the first raster line is formed from the upper side of the area A by the nozzle #1 at pass 4 at which the carriage moves backward (see FIG. 16), the white dots are formed on the color dots. Therefore, in the odd raster lines from the upper side of the area A, it is easy to view the white dots and it is difficult to view the color dots due to the fact that the color dots are hidden behind the white dots, when the color dots and the white dots are viewed from the front side. On the contrary, it is easy to view the color dots and it is difficult to view the white dots due to the fact that the white dots are hidden behind the color dots, when the white dots and the color dots are viewed from the rear side.

That is, according to the printing method shown in FIG. 16, the raster lines in which it is easy to view the color dots and the raster lines in which it is difficult to view the color dots are alternately arranged, even when the color dots are viewed from either side of the front and rear sides of the medium. However, compared to the color images viewed from the front side of the medium, the color images viewed from the rear side of the medium are viewed as right and left reversed images. Therefore, the printing method of S202 is performed when the printed image is the right and left reversed image. Further, when the right and left reversed image is permitted as the printed image, the process of S202 in FIG. 16 may be performed instead of S004 in FIG. 10 (after the process of S003, the process of S202 may be performed without performing the determination of S201).

In the above description, the color dots are formed in all of the pixels. However, the pixels in which the color dots are formed and the pixels in which the color dots are not formed are present in accordance with the color images to be printed. Next, visibility of the color image in this case will be described.

Figure 19A:
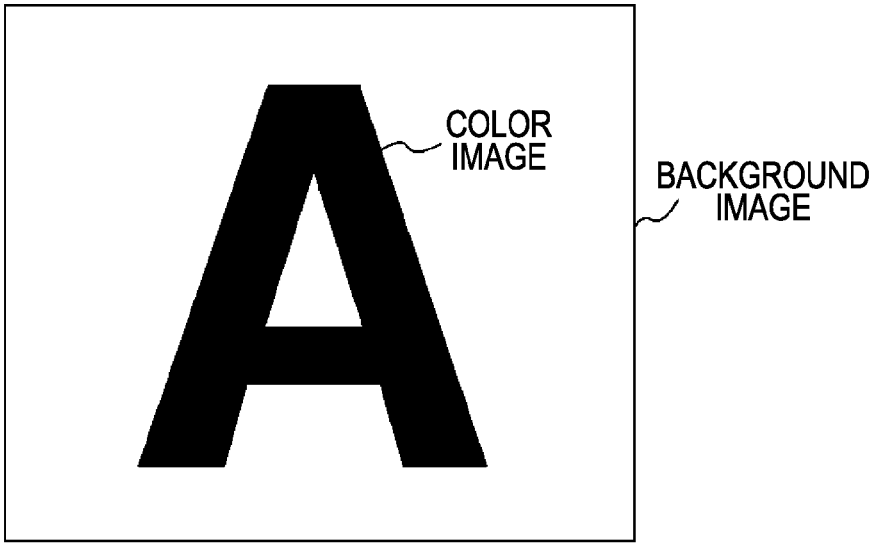
FIG. 19A is a diagram illustrating a color image on image data.

FIG. 19A is a diagram illustrating a color image on image data. Here, a character "A" as a color image is printed together with the background image which is a completely printed image.

The character "A" which is the color image is formed as a completely printed image on image data. Therefore, the color dots are formed in the respective pixels of an area to be completely printed. In other words, the area of the character "A" is an area where the color image and the background image overlap each other. Further, in an area other than the area of the character "A", the color dots are not formed and only the white dots are formed.

Figure 19B:
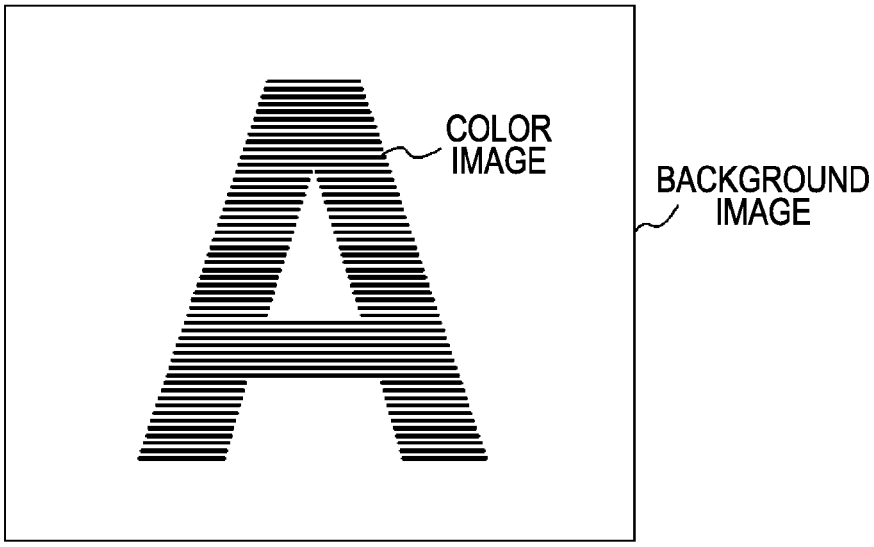
FIG. 19B is a diagram illustrating the shape of a viewed color image printed on a medium.

FIG. 19B is a diagram illustrating the shape of a viewed color image printed on a medium.

The color dots are formed in the continuous raster lines of an area to be completely printed. As described above, according to the printing method shown in FIG. 16, the raster lines in which it is easy to view the color dots and the raster lines in which it is difficult to view the color dots are alternately arranged, even when the color dots are viewed from any side of the front and rear sides of the medium. The width of the raster line is very narrow. Therefore, the approximate color image of the image data can be viewed, when the color image is viewed macroscopically. Thus, as shown in FIG. 19B, the approximate color image (character "A") of the image data can be viewed, even when the color image is viewed from any side of the front and rear sides of the medium.

The example where the color image is the character "A" has hitherto been described, but the color image is not limited to a character (text). In particular, the color image is not limited to the completely printed image. For example, the color image may be a natural image. When a natural image is printed on a medium, the color dots are formed in a dispersion manner. According to the printing method shown in FIG. 16, however, the raster lines in which it is easy to view the color dots and the raster lines in which it is difficult to view the color dots are alternately arranged, even when the color dots are viewed from any side of the front and rear sides of the medium. Accordingly, the approximate color image of the image data can be viewed.

Modification of S202

Figure 20:
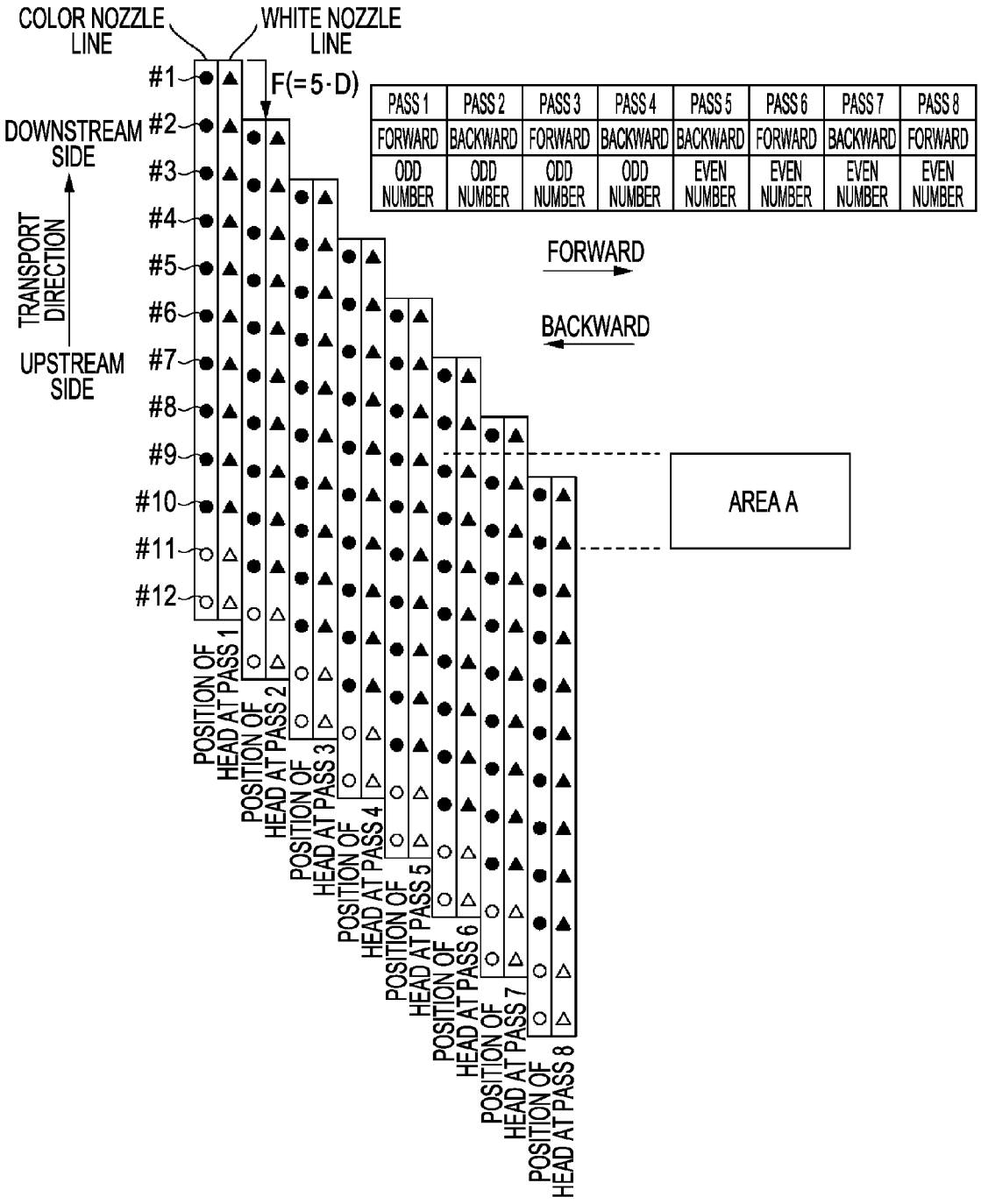
FIG. 20 is a diagram illustrating a printing method according to a modification of S202.

FIG. 20 is a diagram illustrating a printing method according to a modification of S202. When the respective operations of the color nozzle line and the white nozzle line are focused, the overlap printing is performed in both the operations. Even in a printing method according to a modification, the positions of the color nozzles (nozzles #1 to #10) ejecting the color ink in the transport direction overlap the positions of the white nozzles (nozzles #1 to #10) ejecting the white ink in the transport direction, as in the printing method shown in FIG. 16. Even in the modification, the bidirectional printing is performed. As shown in the drawing, the carriage moves forward at pass 1, pass 3, pass 6, and pass 8. The carriage moves backward at pass 2, pass 4, pass 5, and pass 7.

Figure 21A:
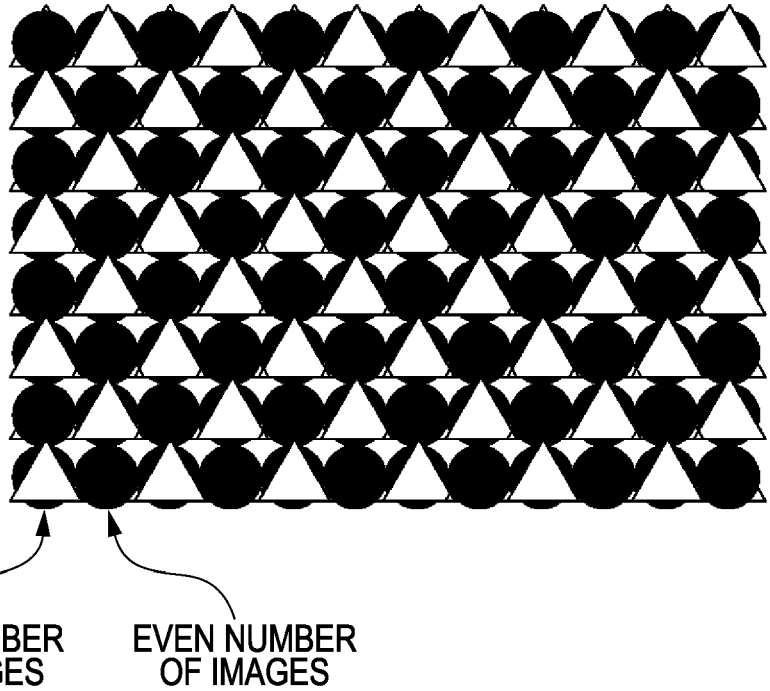
FIGS. 21A and 21B are diagrams illustrating the shapes of dots of eight raster lines in an area A of FIG. 20.
Figure 21B:
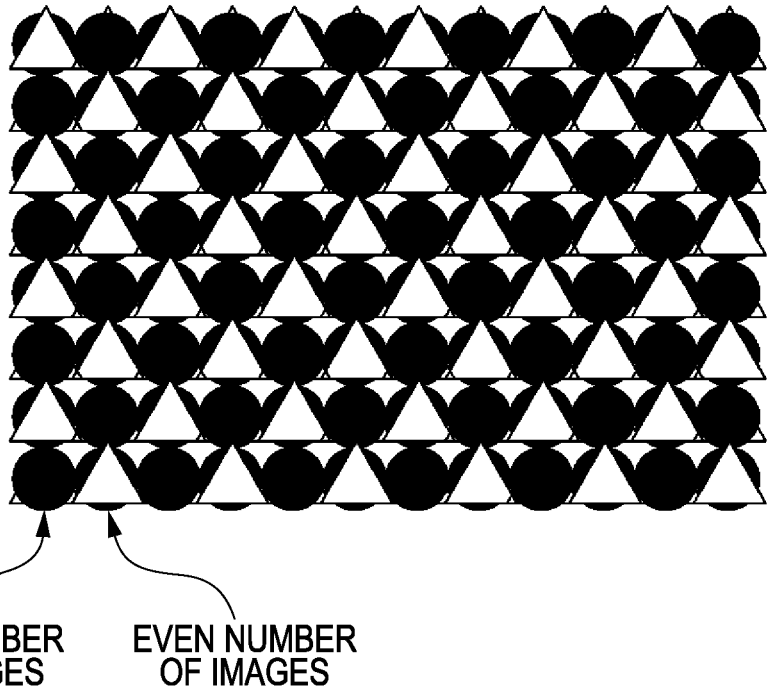

FIGS. 21A and 21B are diagrams illustrating the shapes of dots of eight raster lines in the area A of FIG. 20. FIG. 21A is the diagram illustrating the shapes of the dots viewed from the front side and FIG. 21B is the diagram illustrating the shape of the dots viewed from the rear side. Here, for facilitating the description, the color dots and the white dots are formed in all of the pixels.

In any raster line of the area A, the pixels in which the dots are formed in the forward movement of the carriage and the pixels in which the dots are formed in the backward movement of the carriage are alternately arranged in the movement direction. In other words, in any raster line of the area A, the color dots and the white dots formed at the pass at which the carriage moves backward are located between the color dots and the white dots formed at an interval at the pass at which the carriage moves forward. Therefore, in any raster line, the pixels in which the white dots are formed on the color dots and the pixels in which the color dots are formed on the white dots are alternately arranged in the movement direction. As a consequence, the pixels in which it is easy to view the color dots and the pixels in which it is difficult to view the color dots are alternately arranged in the movement direction in any raster line, even when the color dots are viewed from any side of the front and rear sides of the medium.

In the printing method described above in FIG. 16, since the raster lines in which it is easy to view the color dots and the raster lines in which it is difficult to view the color dots are alternately arranged, there is a concern that a band formed in the movement direction is viewed (see FIG. 17B). Accordingly, in this modification, since the pixels in which it is easy to view the color dots and the pixels in which it is difficult to view the color dots are alternately arranged, it is difficult to view the band formed in the movement direction.

OTHER EMBODIMENTS

In the above-described embodiments, the printer has been mainly described. Of course, the disclosure of a printing apparatus, a printing method, a program, a storage medium storing the program, and the like are included.

The above-described embodiments have hitherto been described to facilitate the understanding of the invention, but should not be construed as limiting to the invention. The invention may be modified and improved without departing from the gist of the invention and the equivalents of the invention are, of course, included in the invention. In particular, embodiments described below are included in the invention.

Nozzles

In the above-described embodiments, the ink is ejected using a piezoelectric element. However, the liquid ejecting method is not limited thereto. For example, another method such as a method of generating bubbles in the nozzles by heat may be used.

Ink

In the above-described embodiments, the UV ink hardened with ultraviolet light has been used. However, the UV ink may not necessarily be used. When the UV ink is not used, the above-described irradiation unit 60 is not necessary.

What is claimed is:

1. A printing apparatus comprising:

a transport unit that transports a transparent medium and winds the medium subjected to printing in a roll shape;

a first nozzle line in which a plurality of nozzles ejecting ink to form a color image are arranged; and a second nozzle line in which a plurality of nozzles ejecting ink to form a background image are arranged;

wherein when a plurality of printed images to be formed by overlapping the color image and the background image continue to be printed on the medium and when the background image of the printed image is located on the outside of the color image in a case where the medium is wound in the roll shape, a confirmation image formed by overlapping the color image and the background image is printed on an end portion of the medium to be wound in the roll shape so that at least a part of the color image is located on the outside of the background image.

2. The printing apparatus according to claim 1, wherein the transport unit winds the medium subjected to the printing in the roll shape so that a printed surface of the medium faces the outside, and wherein when the plurality of printed images to be formed by overlapping the background image on the color image continue to be printed on the medium, the confirmation image formed by overlapping the color image on the background image is printed on the end portion of the medium to be wound in the roll shape.

3. The printing apparatus according to claim 1, wherein the transport unit winds the medium subjected to the printing in the roll shape so that a printed surface of the medium faces the inside, and wherein when the plurality of printed images to be formed by overlapping the color image on the background image continue to be printed on the medium, the confirmation image formed by overlapping the background image on the color image is printed on the end portion of the medium to be wound in the roll shape.

4. The printing apparatus according to claim 1, wherein the confirmation image is printed by allowing pixels in which background dots forming the background image are formed on color dots forming the color image and pixels in which the color dots are formed on the background dots to coexist.

5. The printing apparatus according to claim 4, wherein the color image and the background image are formed on the medium by repeating a dot forming operation of forming the color dots and the background dots on the medium by ejecting the ink from the first and second nozzle lines while moving the first and second nozzle lines in a movement direction and a transport operation of transporting the medium in a transport direction, and wherein when the confirmation image is printed, the pixels in which the background dots are formed on the color dots and the pixels in which the color dots are formed on the background dots are allowed to coexist in an area in which the color image and the background image overlap each other by overlapping positions of the nozzles of the first nozzle line ejecting the ink in the transport direction and positions of the nozzles of the second nozzle line ejecting the ink in the transport direction in the dot forming operation and by repeating the dot forming operation of moving the first and second nozzle lines in a forward direction of the movement direction and the dot forming operation of moving the first and second nozzle lines in a backward direction of the movement direction.

6. A printing method of using a printing apparatus which includes a transport unit that transports a transparent medium and winds the medium subjected to printing in a roll shape, a first nozzle line in which a plurality of nozzles ejecting ink to form a color image are arranged, and a second nozzle line in which a plurality of nozzles ejecting ink to form a background image are arranged, the printing method comprising:

printing a confirmation image formed by overlapping the color image and the background image on an end portion of the medium to be wound in the roll shape so that at least a part of the color image is located on the outside of the background image, when a plurality of printed images to be formed by overlapping the color image and the background image continue to be printed on the medium and when the background image of the printed image is located on the outside of the color image in a case where the medium is wound in the roll shape:

wherein the above process are executed by processor.

* * * * *